United States Patent [19]

Jarlan

[11] 4,014,177

[45] Mar. 29, 1977

[54] MARINE PIER HAVING DEEPLY SUBMERGED STORAGE CONTAINER

[75] Inventor: Gerard Eugene Jarlan, Versailles, France

[73] Assignee: Canadian Patents and Development Limited, Ottawa, Canada

[22] Filed: Sept. 26, 1975

[21] Appl. No.: 617,091

Related U.S. Application Data

[63] Continuation-in-part of Ser. No. 503,079, Sept. 6, 1974.

[52] U.S. Cl. ..... 61/87; 61/3; 61/5; 61/101; 61/102; 114/257; 114/65 A

[51] Int. Cl.[2] ..... B65G 5/00; B63B 35/00; E02D 17/00

[58] Field of Search ..... 61/46.5, 46, 3, 4, 5, 61/52, 87, 101, 102

[56] References Cited

UNITED STATES PATENTS

| | | | |
|---|---|---|---|
| 3,383,869 | 5/1968 | Jarlan | 61/46 |
| 3,858,402 | 1/1975 | Baker et al. | 61/46.5 |
| 3,886,753 | 6/1975 | Birdy et al. | 61/46.5 |
| 3,921,408 | 11/1975 | Lamy | 61/3 |

*Primary Examiner*—Jacob Shapiro
*Attorney, Agent, or Firm*—Gardiner, Sixbey, Bradford & Carlson

[57] ABSTRACT

A vertically-elongate monolithic pier body comprises:

- a deeply-submerged compartmented closed container or container group;
- a near-surface control chamber system;
- a deckwork carried above highest wave level;
- a load-carrying column and wall system extending in part through the container and chamber system, including a pair of perforated flanking walls; and
- a transverse wall and beam bracing framework extending in part through the container and chamber system, including a top wall and a thick slab base.

The pier is intended to stand on seabed in depths of 450 feet to 1200 feet or deeper, to carry petroleum well-drilling and production equipment. The large container group is submerged at a depth where it is subjected to reduced wave pressures. The flanking pair of walls dissipate the energy of incident waves.

Fabrication begins in a drydock site with the pier laid out horizontally extended. The container and chamber end walls are cast flat, and all transverse and load-carrying walls and container sidewalls are upwardly slip-formed. The initial structure is self-floated and towed to sheltered water where construction is completed to a height 200 feet or more. The pier is then towed to its site, turned upright, and sunk to stand on seabed. One or more tubular columns not intersecting the container or chamber systems provide drilling passages.

50 Claims, 26 Drawing Figures

Fig. 9
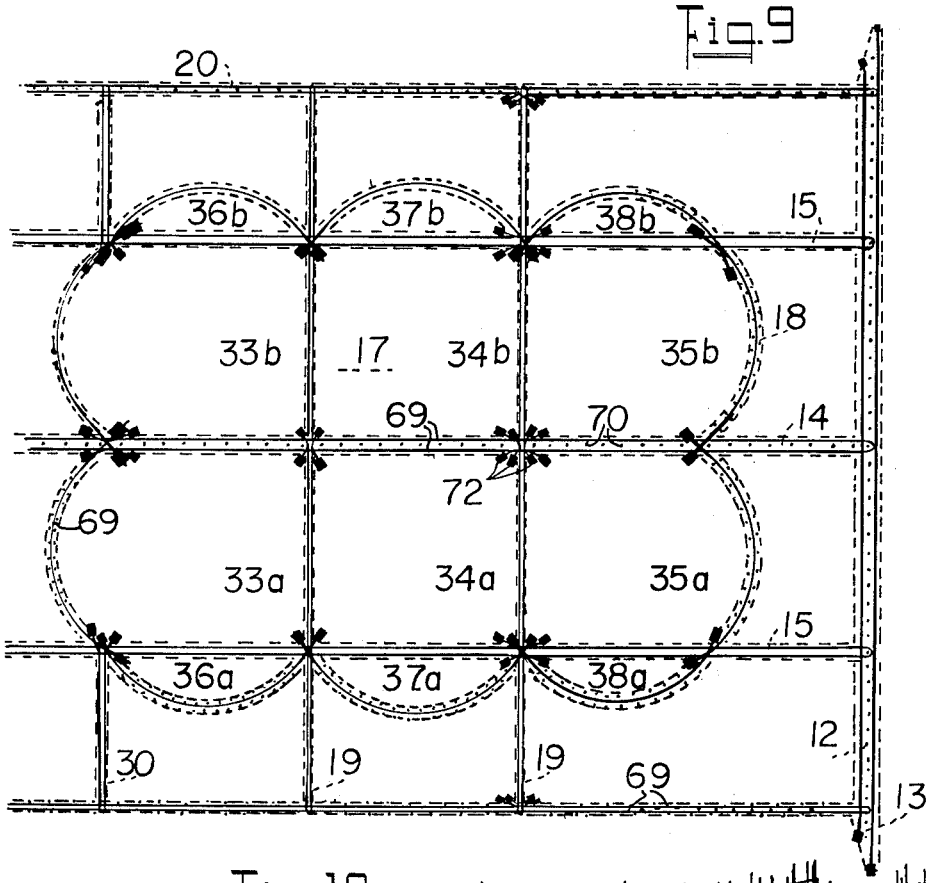
Fig. 10
Fig. 8
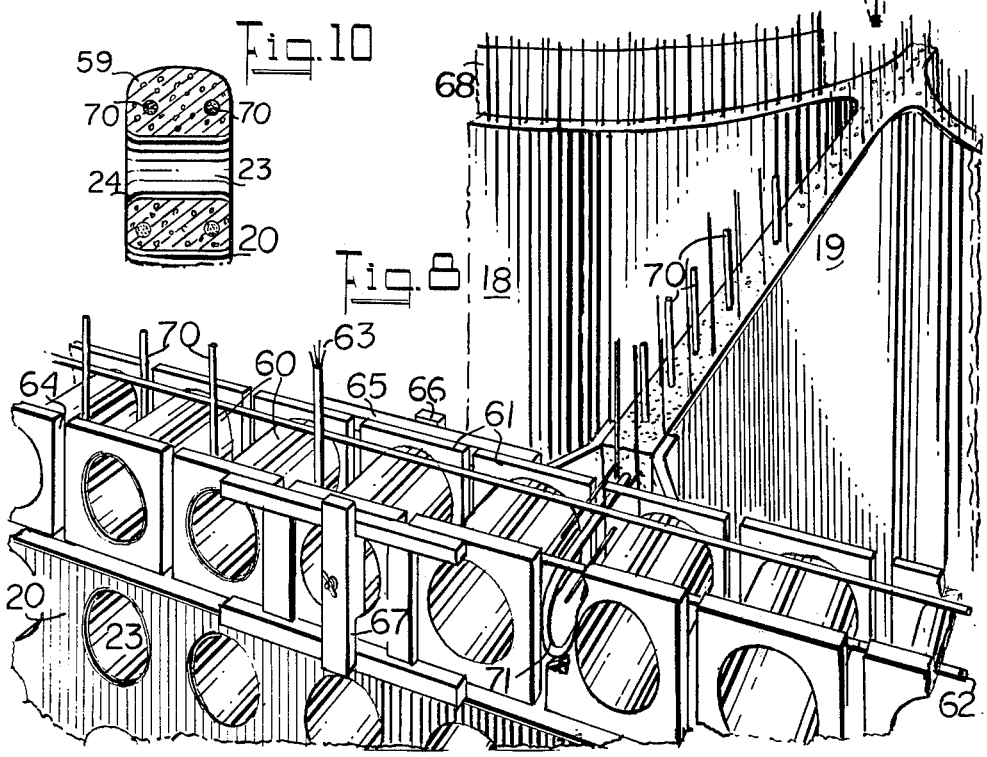

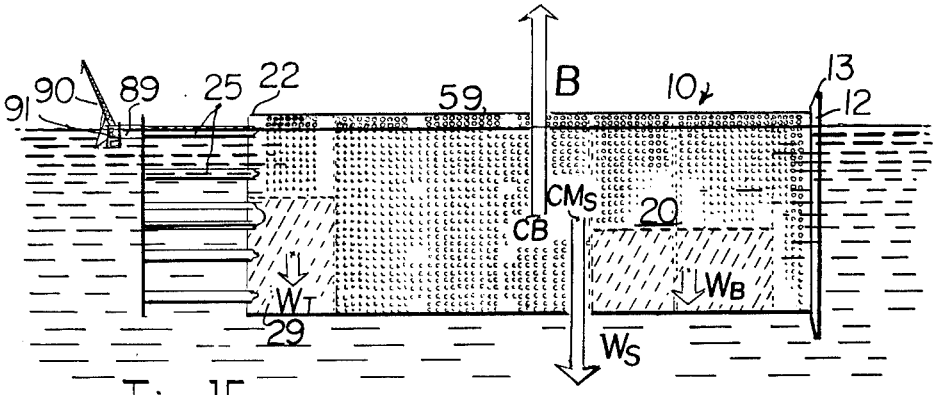
Fig. 15
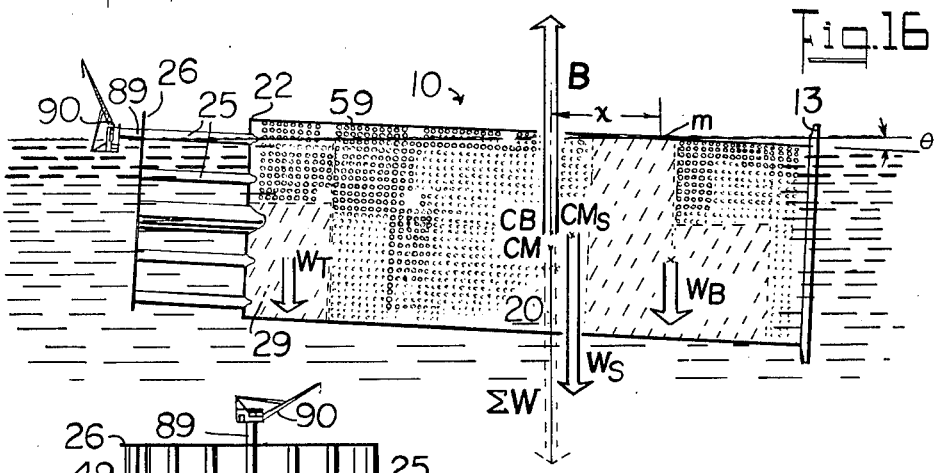
Fig. 16
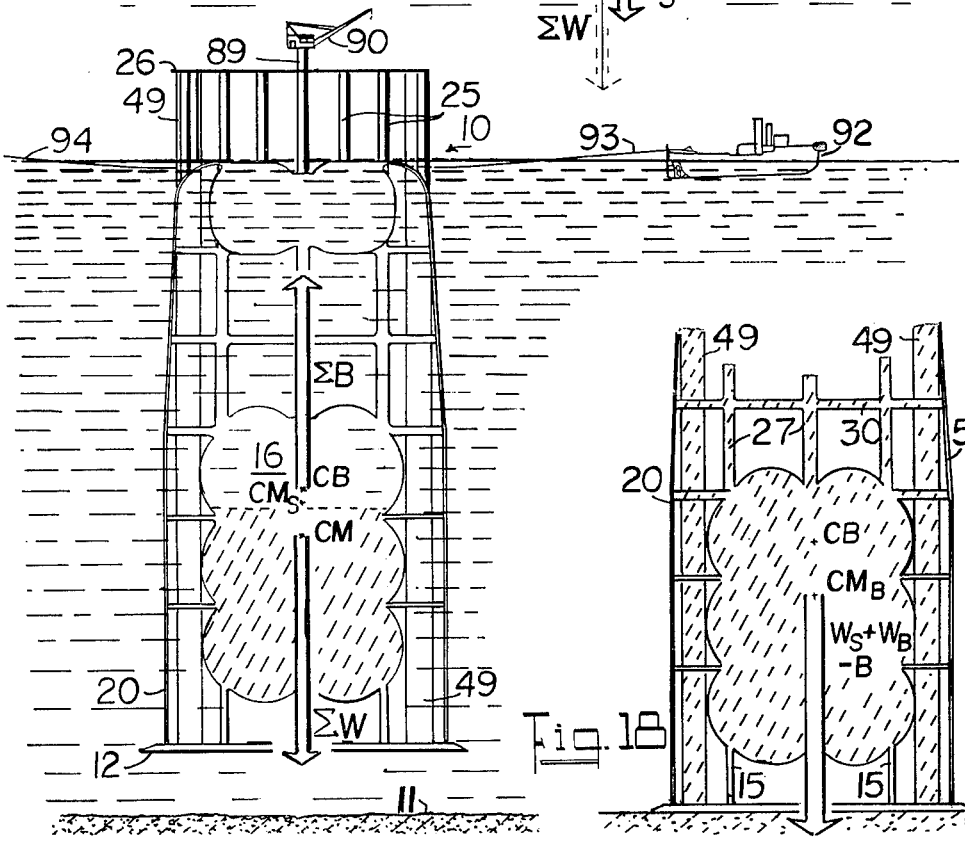
Fig. 18
Fig. 17

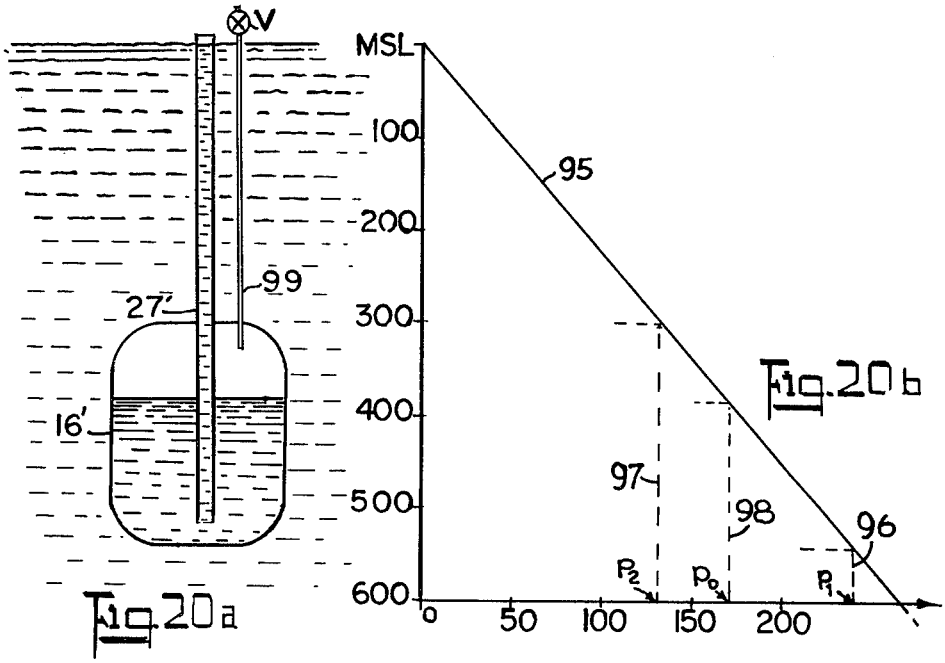
Fig. 20a
Fig. 20b
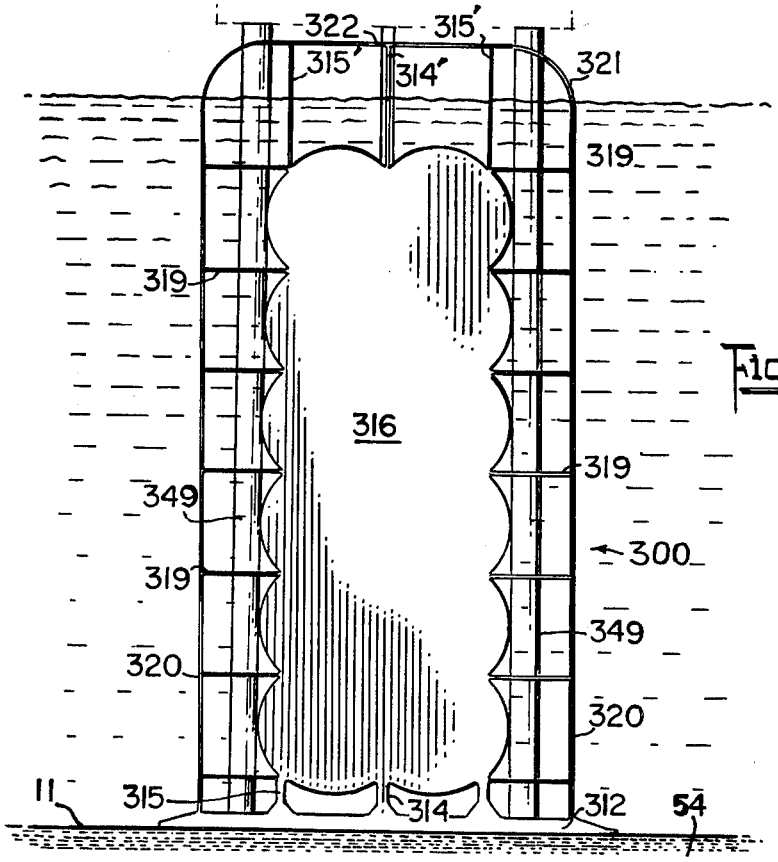
Fig. 26.

226
222'
221
215'
214'
215'
219'
239
229
219
227
232
200
249
230
218
227
230
220
219
216
249
215
214
215
11
212

MARINE PIER HAVING DEEPLY SUBMERGED STORAGE CONTAINER

CROSS-REFERENCE TO RELATED APPLICATION

This is a continuation-in-part of application Ser. No. 503,079 filed Sept. 6, 1974.

BACKGROUND OF THE INVENTION

Heretofore marine piers constructed for stability when standing on seabed in water deeper than 100 feet have proposed to store fluid materials in one centered tank or in a cluster of tanks having upright axes carried on a base slab and extending upwardly beyond the level reached by the largest amplitude gravity waves propagating over the site. Such piers have required the construction of a peripherally-complete surrounding wall capable of transforming the full energy of incident waves to solely kinetic energy of stream flow of seawater as jets guided by the bounding surfaces of channels constituted by perforations opening through the wall, as fully described in U.S. Pat. No. 3,383,869 to G. E. Jarlan.

The construction of the prior art pier requires an initial drydock building phase to fabricate a pan or raft upon which the bottom of the tank cluster is erected and which extends radially to provide a base for the surrounding perforated wall, followed by slip-forming of the upwardly-extending concrete structures, towing the pier structure to a site, and lowering it to stand on seabed, as described for example in *Civil Engineering*, August, 1973, Gerwick Jr., and Hogenstad, E. — "Concrete Oil Storage Tank Placed on North Sea Floor".

Two disadvantages of the prior structure and method are evident in attempting to scale the dimensions of the prior pier upward to stand in very deep water and store a volume of fluid of the order of three million barrels, namely, the increased moment arm at which the lateral thrust due to wave forces is directed toward the structure, increasing the risk of sliding and unsafe rocking displacements, and, the greater cost per unit of storage volume due to the longer fabrication time required and the larger mass of concrete, reinforcement, and post-tensioned steel tendons necessary to build a perimetral perforated wall. A protected deep-water building site at which a pier of vertical extent approaching even 300 feet can be built is rarely available within a safe towing distance from the final site.

Even when the storage chambers of the prior art pier may be depressed so that their upper ends do not extend above the sea surface, to reduce wave pressures, the difficulties noted above would apply, compounded by any climatic obstacles such as frequent bad weather, distances from sources of construction materials and expense of maintaining a large working force by ship supply.

STATEMENT OF THE INVENTION

Marine piers according to the invention are intended to stand on seabed in relatively deeper waters than any marine structure of free-standing form hitherto proposed, and are particularly suitable for open sea sites where the severest waves propagate, in water depths of from about 450 feet to about 1,200 feet or deeper.

The pier structures of this invention provide novel support and protection for an integral storage container or container group of very great volume, wherein the greater bulk of such container body or bodies is well below the upper levels of the sea in which propagating deep water gravity waves exert large pressure forces on vertical surfaces of large span. For example, when the maximum expected amplitude ($2a$) equals one-hundred feet and the period of such large wave is 16 or 17 seconds or longer, the lateral wave forces acting on a large storage container having length, width and height each larger than 200 feet, would be of the order of 10 tons per square meter near sea surface; yet when the highest surfaces of the container are about 300 feet below mean sea level the body may be subjected to peak forces not exceeding about 1.5 tons per square meter.

Even at depths of the order of 1,000 feet, which is only about a half wavelength of a wave of period 18 seconds, substantial orbital particle motion exists, so that the presence of a very large vertical area rising from the seabed induces substantial under-pressures, setting up currents tending to erode seabed materials. It is an important aspect of this invention that there is provided a relief passage of large cross-sectional area through the pier by positioning the under surface of the storage container or container group above the seabed a distance appropriate to the depth and wave conditions at the site.

The novel pier is characterised by a vertically extended height greater than either side dimension in plan and is a unitary structure essentially comprising a very large compartmented closed container or container group supported above seabed to have at least the greater part of such container body deeply submerged, upon short upright parallel load-bearing walls spaced along a thick slab base resting on seabed, which slab may be about 300 to 400 feet broad by 200 to 250 feet wide. The load-carrying walls extend upwardly through the container or container group as compartmenting or dividing walls that transmit vertical and horizontal loads acting on the container as well as loads exerted by the upper pier structure on upward extensions of the intersecting load-carrying members, which extensions comprise wall and/or column members. A flanking pair of load-carrying walls which rise from the slab base are spaced on opposite sides of the container or container group and are extensively perforated over their vertical surfaces by a large multiplicity of transverse channels along which free movement of seawater is provided, the movement being controlled by the bounding surface of each channel to cause jets to issue from the channel ends along the jet-guiding axes thereof. The container or container group have the form of cylindroidal capped-ended bodies with cylinder axes horizontal and parallel with the minor dimension of the base, and are further divided by a system of transverse parallel intersecting brace walls joined with the flanking pair. The entire pier structure is unified by a system of transverse brace members, including a top wall, and such further spaced horizontal walls and/or tubular brace beams as the height and particular design of pier require. A superstructure is supported by the pier to stand clear of the sea, from which access is provided to the spaces within the container or container group by way of passages formed to extend along the load-carrying members.

To assure control of horizontal stability when the pier is floating during construction and when in transport under tow, as well as to provide for adjustment of the relative positions of center of buoyancy and center of mass, to achieve righting into vertically extended, stable floating attitude, a portion of the storage container or container group is located in the upper part of the pier, relatively close to the mean sea surface when the pier is standing. The volume, proportions, and location of such control chamber portion is determined for each specific pier design, so that the cross-section presented to the waves will not produce sliding, rocking, or overturning under the worst sea conditions combined with currents and wind velocity and direction, yet the contribution of buoyancy by such portion must be sufficient both for horizontal stability and to obtain positive self-righting when desired.

GENERAL OUTLINE OF PRACTICAL EMBODIMENTS

Marine piers constructed in accordance with the present invention may be embodied in a variety of forms each capable of safely standing in the deep ocean, with the bulk of the storage container or container group deeply submerged and having a lesser volume portion positioned in shallower depths, either as a separate container group serving as the control chamber, or as an upward continuation of the storage container group, and with the upper extremities of the pier modified as appropriate to the conditions predictable for the site over very long time periods. For a depth of about 600 feet at a site exposed to waves of long fetch arriving from almost any direction having very long periods and of amplitude approaching 100 feet or more, a pier form will be constructed having the control chamber portion separated from the main storage container or container group and located just below low water wave level under a submerged top wall. The volume and end area of the control chamber portion will be generally chosen to be a fraction of the volume and end area of the main storage container or container group, as determined by model studies and computations to satisfy stability and control requirements, and the deeply-submerged container upper surfaces will be located not higher than about 300 feet below mean sea surface. The load-carrying members between the main storage container and the control chamber portion will be tubular columns, braced by transverse tubular beams uniting the columns with the flanking pair of walls which terminate in curved upper extremities merging with the submerged top wall. The superstructure is carried above the waves upon a large number of relatively slender hollow pillars rising from the top wall.

Another pier structure according to the invention may be constructed to stand on ocean sites where for example currents are known to be small and the greatest amplitude of waves likely to be encountered will be less than about 80 feet and the larger waves arrive only from a limited sector of the ocean where the depth may be as much as 700 feet. Such pier will have the storage container or container group located below a depth of about 250 feet and will have a separate control chamber portion supported near mean sea surface on load-carrying columns united with the flanking pair of walls by tubular brace beams and by horizontal brace walls which are perforated. The top wall is located just above the highest wave reach, and is supported with its surmounting deckwork upon load-carrying perforated walls extending from the upper surface of the control chamber portion. For minimal wave pressures such pier form will be erected to stand with one of the perforated flanking pair of load-carrying walls disposed generally perpendicular to the paths of the larger-amplitude waves.

The invention may also be expressed in accordance with the invention in yet another form when a pier structure is to be erected to stand in ocean depths of from 450 feet to 1200 feet or more on a firm seabed where negligible currents prevail and the wave heights are predictably moderate, for example not exceeding about 30 feet in amplitude and being of intermediate period lengths, by constructing the storage container or container group as a single upwardly-elongate compartmented body extending from the base or from just above the base to a height near mean sea level, wherein all of the load-carrying members comprise planar walls and the transverse brace members are also planar, and the top wall is perforated and spaced above the sea, carried on perforated upward extensions of the load-carrying walls, the upper compartments of the storage container group serving as control chamber portions.

GENERAL OUTLINE OF CONSTRUCTION AND ERECTION

In the construction of the forms in which the marine piers according to the invention may be realised, the structures are built with their long dimension, i.e. the height, and the intermediate dimension, i.e. the breadth, in the horizontal, so that the least dimension — namely the width — is vertical during the entire construction phase. All load-carrying members and brace members which are of planar wall form, as well as the curved closing side walls of the storage container or container group which have vertical axes may be slip-formed as reinforced concrete castings having emplaced tendons, using the greatest possible length of formworks. The floating state may be reached in a small number of "lifts" or stages. The base of the main storage container or container group and the base of the control chamber portion — if separate — are each constituted by respective capping end walls and provide pans when initial wall portions have been cast on the margins of these end walls so that positive buoyancy is achieved early in the construction.

Such pier forms are all initially commenced as dry land construction employing a drydock adjacent a sea of moderate depth initially separated from the drydock by a seawall of piling and rubble, enabling floating and towing the initial form to protected deeper water, for example 180 feet in depth. The width dimensions of a pier will be limited by the greatest depth of a sheltered sea site at which construction may proceed to completion while floating. Nevertheless, where protected deeper water may be available, pier widths considerably greater than 250 feet may be realised.

The completed pier is suitably trimmed by ballasting the storage container and control chamber portion spaces, and the pier is taken in tow as a vessel with base aft. During the ocean journey to its site the pier is relatively shielded from beam waves by reason of the wave-dissipating action of the flanking pair of walls, which markedly reduce the reflection coefficient of the structure for waves, and which moreover serve to abate the bow wave created by the forward motion of the vessel. When delivered to the site area, ballasting and pressurizing of the storage container or container group is effected by equipment transported on a margin of the partial deckwork so that the pier floats stably horizontal, nearly submerged. The control chamber portion spaces are de-ballasted and the lower storage container spaces are filled, at a pressure in balance with the sea pressure, to achieve a righting moment causing rotation of the pier body about a transverse axis in its upper part. When the pier floats stable and erect, more ballast is added to lower the pier to stand upon a favorable flat area of seabed. Further ballasting by seawater to fill all container spaces including any vertical and horizontal columns and beams effects pier anchoring by its own weight and prevents over-stressing the container walls by hydrostatic pressures. Erection of final deckwork, installation of cranes and drilling rigs and supplies, contributes to the base bearing load to resist sliding. Drilling operations may proceed utilising one or more vertical columns provided which do not intersect the storage container or control chamber portion.

The seabed area preferred for the pier site will be an undisturbed reasonably smooth flat and level natural deposit of sands, certain silts, and clays, of substantial thickness overlying any competent bedrock structure. Cores will preferably be taken to ascertain the ability of the layers to support a distributed vertical load which may be greater than one ton per square foot, and to resist a lateral thrust exerted by wave and current motions of seawater acting on the pier surfaces which forces may exceed 20,000 tons. Certain deposits are not suitable, e.g. certain delta silts, and volcanic ash deposits, although in some locations a mattress of rock materials may be laid on seabed and on the pier margins to improve support.

The pier will be designed to ensure stability when standing on the selected site, where suitable particulate soil materials constitute the seabed, i.e. to ensure that periodic thrusts may be safely resisted over a great period of time. In general, the ratio of horizontal forces to the immersed weight of the pier will be made sufficiently low that the resultant of the horizontal and vertical loads, as represented by vectors, intersects the base slab within a prescribed fraction of the base dimension from its center. The underside of the pier base may be ribbed conventionally to develop maximum soil shear strength.

DESCRIPTION OF PREFERRED EMBODIMENTS

The invention may be understood from the description which follows with reference to the accompanying figures of the drawing illustrating preferred marine pier forms, and the methods of their construction and handling in the dry-land supported stage, in the floating construction stage, in the pier-righting stage, and in the seabed-supported stage, in which:

FIG. 8 is a perspective view showing fabrication of the flanking wall, a lateral brace wall, and the storage container group sidewall;

FIG. 9 is a top plan view showing in phantom outline the main storage container group, flanking walls and base, and diagramming location of post-tensioning tendons;

FIG. 10 is a horizontal section through a margin of the flanking wall of FIG. 1, in enlarged scale, taken on line 10—10;

FIG. 15 is a side elevation view of the completed pier floating horizontally, diagramming freeboard-reducing and forward-trim ballast adjustment following arrival over the site;

FIG. 16 is a further side elevation view of the pier of FIG. 15 diagramming adjustment of the ballasting to achieve incipient self-turning into stable upright floating attitude;

FIG. 17 is a side elevation view of the pier of FIG. 16 following transfer of trim ballasting to the lower container spaces diagramming principal forces acting on the structure;

FIG. 18 is a partial side elevation view of the pier of FIG. 17 following filling of all internal spaces with fluid, diagramming vertical loads carried by the base;

Figure 23:
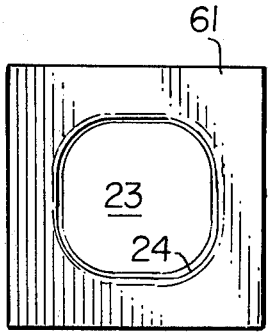
Figure 20:
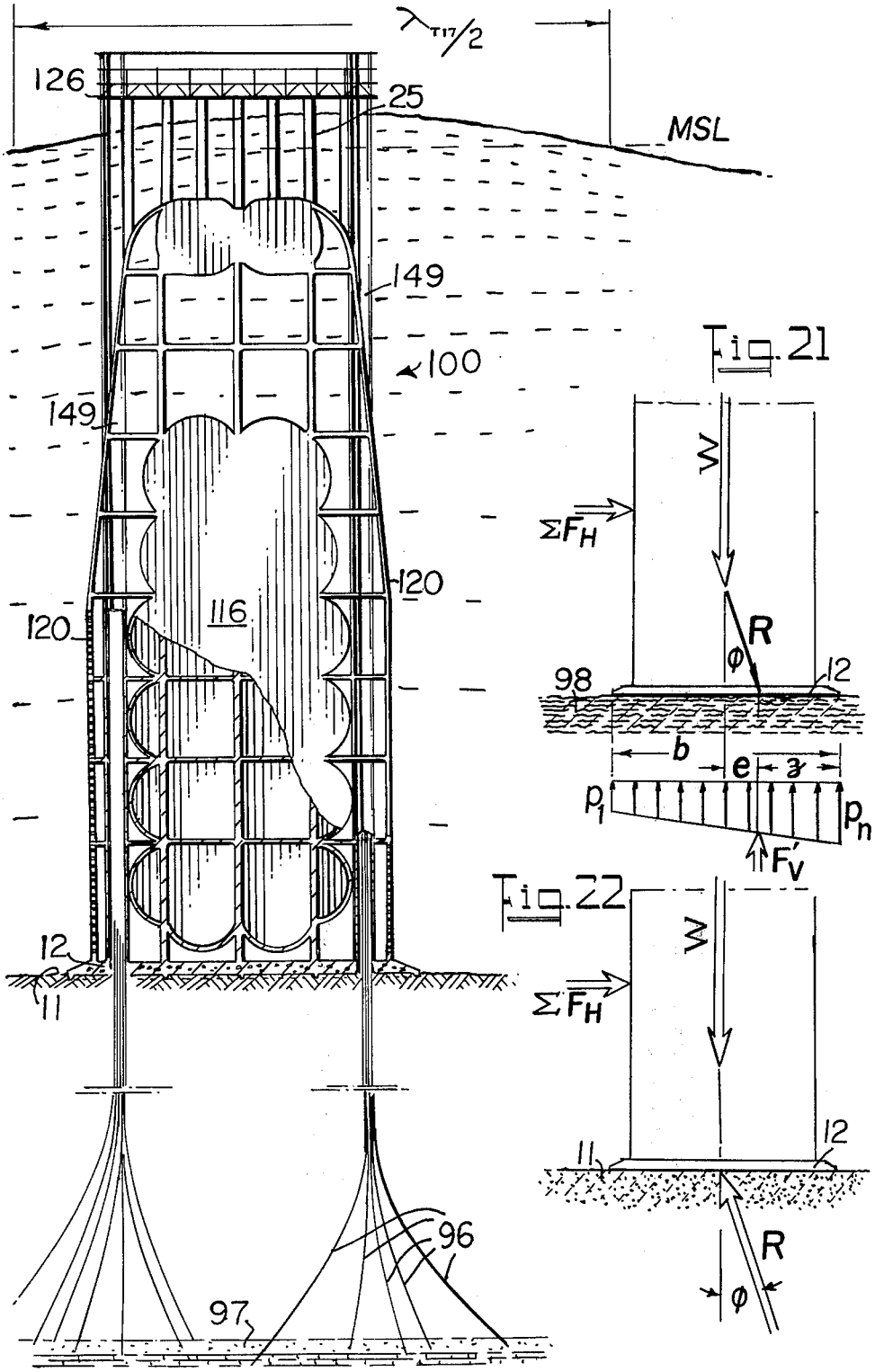
Figure 25:
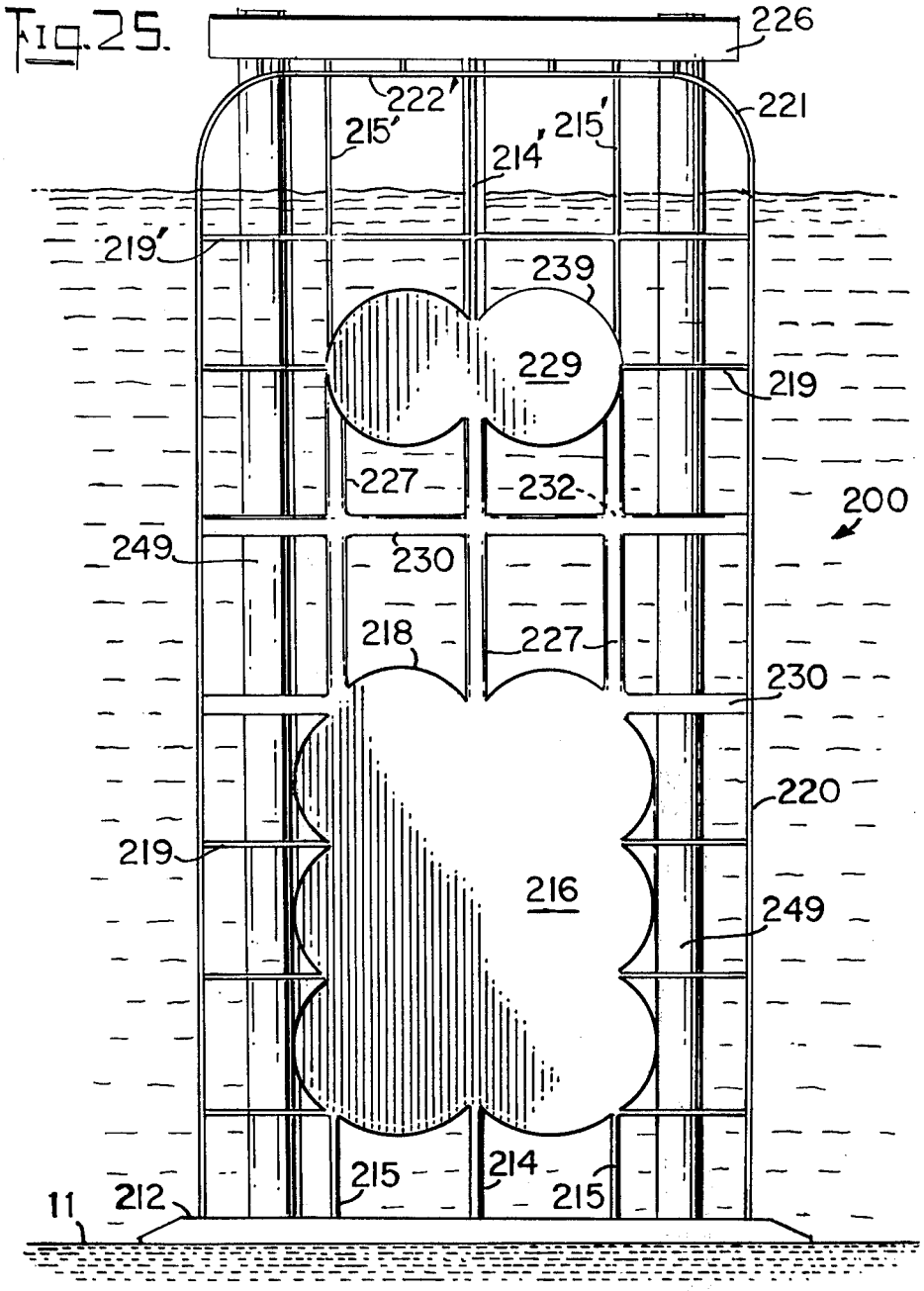

FIGS. 20*a* and 20*b* are related hydraulic column diagram and sea pressure/depth graph illustrating pressures acting on a submerged container having a head space;

FIG. 21 is a side elevation view of an alternate form of pier for siting in a great depth, illustrating well drilling and petroleum production operations;

FIG. 22 is a diagram analysing stability of a pier according to the invention, sited on a seabed composed of sedimentary materials of low shear strength;

FIG. 23 is a diagram similar to FIG. 22 analysing pier stability when standing on a packed hard sand seabed;

FIG. 24 is an end elevation view showing an alternate construction module for building a wall of high perforation ratio;

FIG. 25 is an elevation view of an alternative pier having load-carrying, top wall, and bracing walls perforated;

FIG. 26 is an elevation view of still another pier form for sites not subject to large waves, having a continuous container group.

Figure 1:
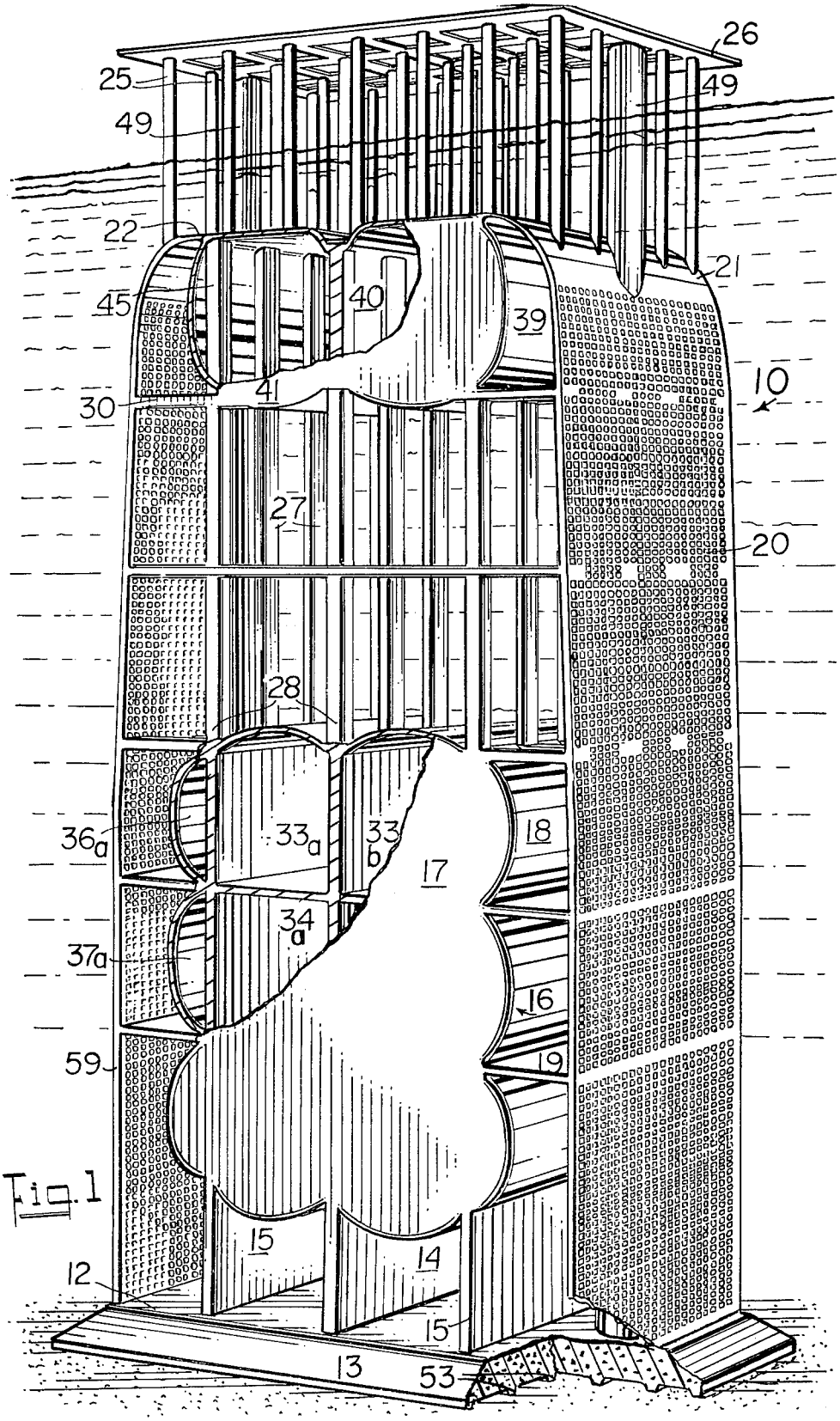
FIG. 1 is a perspective under-sea view of one form of standing pier constructed according to the invention to withstand severe wave conditions.

Referring to the drawing, a marine pier generally designated 10 constructed according to the invention is shown in FIG. 1 standing on seabed 11. The pier structure comprises a thick slab base 12 including flange extensions 13 enlarging both the width and breadth dimensions of the base. Such flange extensions may be of tapering thickness as shown. In one specific design, the breadth may be of the order of 320 feet and the width 220 feet and the slab extensions project 25 to 30 feet.

The vertical and horizontal loads of the pier are transmitted through a system of three vertical walls comprising a centered wall 14 and auxiliary vertical walls 15, spaced apart about 90 feet on centers along the breadth dimension and joined integrally with the base. The vertical walls are solid, and are cast as reinforced concrete structures including steel tendons for post-stressing, by the techniques to be described at a later point. They rise to a height of about 300 feet, and extend through the interior of a closed shell-walled cast container body generally designated 16. The walls have a horizontal width dimension which is coextensive with the distance between the capping end walls 17 closing the container and are monolithically formed with these end walls. Relatively short free-standing lower portions of the vertical walls extend between the base 12 and the lower convexly-lobed side wall 18 of the container body, which side wall has curvatures about horizontal line axes parallel with the width dimension of the base. The vertical walls terminate at their junction with the uppermost portion of the container side wall 18.

Horizontal forces directed against the pier structure are in part transferred to the base through the vertical walls 14 and 15, and in part by two vertically-spaced horizontal brace wall members 19 that intersect the vertical walls at two levels approximately located at the one-third and two-thirds height positions of the container 17. The brace walls 19 extend beyond the container side wall 18 and terminate in monolithic junctions with a pair of flanking walls 20 that rise from the slab base and extend above the container to a height such that their upper inwardly-curved terminal portions lie in a depth of about 60 to 90 feet below mean sea level (MSL). The pair of flanking walls are substantially vertical and parallel, at least throughout their lower extents, but may be slightly inwardly inclined but straight or very gently curved at heights above the storage container group. Their sections in any horizontal plane are bounded by straight parallel lines. Curved upper portions 21 are curved with band curvature, i.e. about horizontal line axes parallel with the width dimension. The walls are spaced 40 to 60 feet from the sides of container 16, and even larger distances will be chosen where very long period waves of large amplitude will be encountered.

The pair of flanking walls merge monolithically with a top wall 22 extending generally horizontally between the flanking walls, which top wall is solid, whereas the greater part of the vertical extent of the flanking walls is perforated by a large number of transverse channels or ducts 23, arranged in a regular distribution pattern over the entire vertical surface of each flanking wall. The channels or ducts 23 are so designed that they are efficient jet-forming elements, through which seawater may move freely under the lowest hydraulic head differentials and from the discharge ends of which channels or ducts jet streams of seawater issue, maintaining their movement along the axial direction extended beyond the wall for many diameters. The function and design of such openings or passages have been fully described in the aforesaid United States patent and need be only briefly noted here. In general, for lowest resistance to mass transport of seawater through such perforated wall the channel diameters and lengths will each be in the range of about 3 to 4 feet, and the limits of channel length are from 0.8 diameters up to about 3 or 3.5 diameters, assuming that the cross-section is circular. However the cross-sectional outlines of the channels may also be elliptical, rectangular, or formed as combinations of straight sides with curved corners.

The cross-sectional area may be uniform along the axial length, or a small tapering of the channel sides may be adopted, the reduction preferably progressing inwardly from the seaward side. Where the highest ratios of aperture area to wall elevational area are to be achieved, the channel section outlines can be essentially square with rounded corners, and the concrete section between adjacent channels reduced, while still allowing placement of reinforcing steel and post-tensionable tendons. Where the pair of flanking walls will be subjected to the greatest wave stresses in sea surface layers, as when the pier is towed as a vessel, strength requirements may limit the perforation ratio to 40% or less, i.e. the elevational area of concrete will comprise 60% or more of the total elevational area of the wall.

The pair of flanking walls serve as wave energy-transforming elements having very low reflection coefficients to waves incident normally upon the wall or at some angle to the normal when the perforation ratio is about 30%. As is well known, orbital particle motion may be substantial even at a depth of 0.4 wavelength for a long-period deep water gravity wave having an amplitude ($2a$) of 100 feet at MSL, the orbital diameters decreasing non-linearly with depth to about one-tenth the surface values at about 0.3 wavelength as may be understood from FIG. 19. The flanking walls are wholly effective to transform wave motion, i.e. the orbital particle motions about generally horizontal axes of seawater undergoing gravity water wave disturbance in the open sea, into solely unidirectional motion, hence the waves incident on the flanking wall are destroyed and the axial jets guided by the channels have kinetic energy derived from the original wave components which energy may be rapidly dissipated in vortexial turbulence generating heat through viscous friction phenomena.

The openings of channels or ducts 23 into the exterior surfaces of flanking wall 20 preferably have toroidally-curved entry portions 24 to improve the efficiency of conversion of hydraulic head pressure to kinetic energy of jet flow.

Top wall 22 supports an array of pillars 25 spaced in a regular distribution pattern over its upper area. The pillars project above the sea surface and rise beyond the highest wave level which may reach +60 feet, and carry upon their upper extremities a deckwork generally designated 26.

Figure 2:
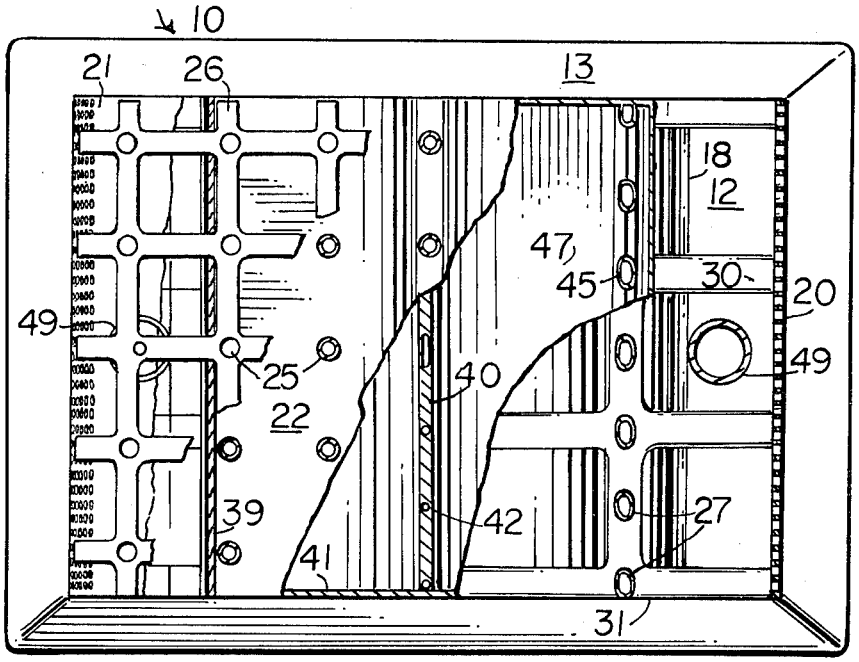
FIG. 2 is a top plan view partly cut away looking down on a succession of horizontal sections of the pier of FIG. 1.

Between the top wall 22 and the upper surface of storage container 16 there extend a number of vertical columns 27, their lower end portions 28 being monolithically joined with the container side wall 18 and their upper portions merged within a control chamber 29 underlying the top wall 22. The vertical walls 14 and 15 and respective groups of the vertical columns are in vertical alignment; as may be seen from FIGS. 1, 2 and 3, the columns are arranged as hollow tubular load-carrying structures in groups of seven, the members of each group being spaced along the width dimension and the outer members being generally flush with the container capping end walls 17. The vertical columns may have greater cross-sectional areas at positions near the mid-width of the pier to accomodate service piping and ballast-handling conduits. Columns located outermost preferably have relatively small breadth dimensions and greater width dimensions, to minimize wave pressures. The combined horizontal cross-sectional areas of the walls of all vertical columns should be adequate for transfer of all vertical loads due to the deckwork and equipment, top wall 22, control chamber portion 29, and the upper portions of the flanking walls, as well as downward vertical wave pressures that may be directed on the top surface of wall 22.

The flanking walls and the vertical columns are tied together monolithically by a system of horizontal tubular beams or struts 30 extending in the breadth dimension. The arrangement illustrated comprises four ranks of beams or struts of which the most forward and most rearward ranks lie with side surfaces 31 flush with the container capping end walls and the other two ranks occupy positions corresponding to the one-third and two-thirds pier width points. The lowermost tier of beams or struts 30 comprises only those portions between the flanking wall and the container side wall at its junction with the upper terminus of an auxiliary vertical wall 15, while the uppermost tier similarly comprises only the portions extending between the flanking wall and the junction of vertical tubular columns 27 with the lower surface of the control chamber portion 29. An intermediate tier extends from one flanking wall to the other.

Further tubular braces 32 extend between the vertical columns 27 in the width dimension at right angles to both the beams or struts 30 and to the columns, and are arranged as a tier at the level of the intermediate tier of the beams or struts 30, and another tier at the level of the upper tier of beams 30 under the control chamber portion 29. The vertical columns, the horizontal beams and the braces are all fabricated as hollow reinforced concrete structures, with cross-sectional outlines which give rise to relatively low drag loads when subjected to seawater motion; however rectangular sections with rounded edges may be employed where economies of fabrication require, at the cost of slightly increased drag forces and consequent horizontal thrusts. The longer dimensions of the sections should preferably lie along the direction of flow for which drag is to be minimized, i.e. the vertical columns will have greater width than breadth dimensions, and the horizontal members 30 and 32 will have greater horizontal than vertical dimensions, in vertical sections. The moments of inertia of the sections and their column lengths should be such that the member is structurally safe under combined compressive, torsional, and bending loads due to wave pressures on the pier, and its structural loads. Systems of steel tendons (not shown) are incorporated, and tensioned to post-stress the members following their fabrication and joining together monolithically.

Referring particularly to FIG. 1 and FIG. 9, it may be seen that the intersecting, monolithically integrated vertical load-carrying walls 14, 15, and the brace walls 19 create a series of enclosed volumes designated, in descending order, an upper main pair 33*a* and 33*b* partly enclosed by the top surface of the container side wall; an intermediate main pair 34*a*, 34*b* and a lower main pair 35*a*, 35*b* partly enclosed by the lower surface of the container side wall 18. In addition, enclosed volumes of lesser size are designated 36*a*, 36*b;* 37*a*, 37*b;* and 38*a*, 38*b*, all enclosed between a segmental portion of the container side wall 18 and the adjacent auxiliary vertical wall 14. Each of the spaces is provided with a system of conduits or passages (not shown) which may be welded steel tubes embedded in the center upright wall and in the auxiliary upright walls and leading through certain of the vertical tubular columns and certain ones of the pillars 25 to the deckwork 26. The twelve spaces represent a very considerable storage capacity for fluid materials such as petroleum, brines, or solution. Various handling facilities (not shown) may be included for remote operation from the deckwork, to place, remove, or transfer the fluids as desired, and may comprise valves, doors, gates, actuators, pumps, motors, sensor devices, and control lines, of conventional form as are well known particularly for handling large flow rates of oil or water.

The structure of the control chamber portion resembles, in part, that of the main storage container body 16, in that it is a subdivided enclosed shell body, having a convexly lobed outer or side wall 39, at least one central upright dividing wall 40, and end capping walls 41. In general, the end wall areas will be of relatively small size as compared with the area of container end walls 17, yet the internal volumes of chamber portion 29 should be great enough to permit appropriate ballasting and to provide a displacement equivalent to the negative buoyancy of a partial deckwork and of the solid top wall 22, as will be discussed in greater particular at a later point. The distance between the curved terminal portions 21 of the flanking walls 20 and the chamber side wall 39 should be substantial, to allow dissipation of jets flowing inwardly through the upper apertures 23, for example 40 feet or more.

Figure 11:
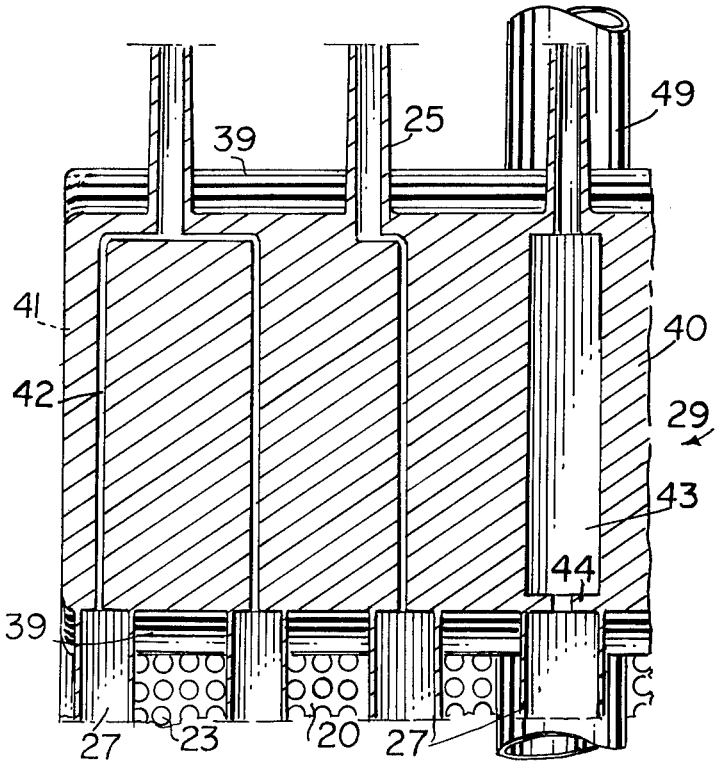
FIG. 11 is an elevation view of a section through the center upright wall of FIG. 2 on line 11—11, showing ducting in the control chamber portion of the container group.
Figure 12:
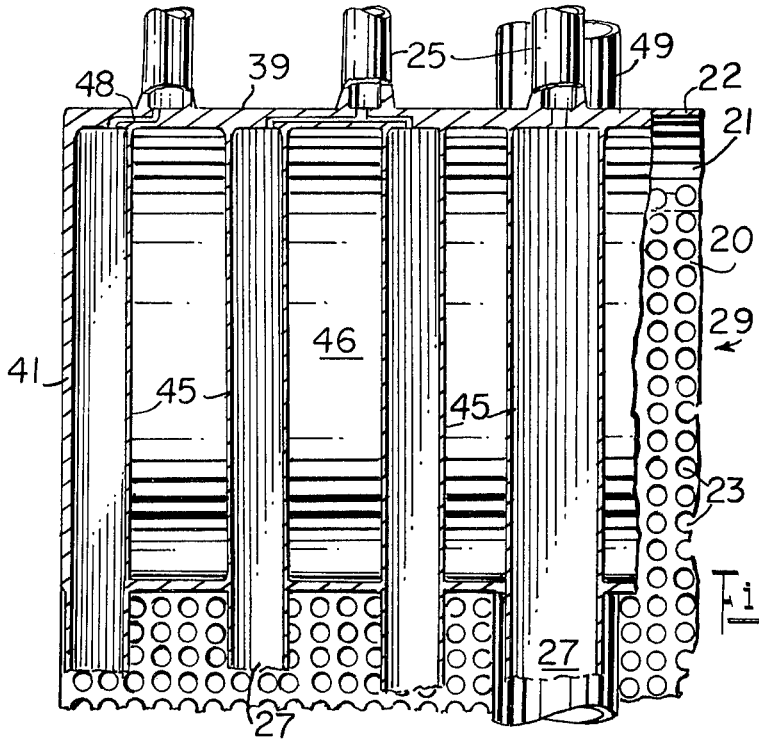
FIG. 12 is an elevation view of a section through the vertical column group on line 12—12 of FIG. 2, showing passages through the control chamber portion.

The upright dividing wall 40 is preferably utilised as a support for the larger vertical conduits used for flow of materials between the above-sea structure and the spaces 33–38. Further referring to FIGS. 11 and 12, the wall 40 will be seen to have tubular passages 42 affording location of pipes along which materials may be delivered up or down from a pillar 25 to a column 27, and a central enlarged passage 43 may be provided for movement of equipment. A bulkhead is preferably provided at the lower end of passage 43 at which a water door (not shown) will be fitted to isolate the space within the central column 44. The upper portions of vertical columns occupying positions in the files to the left and right of the central file in which central column 44 stands, designated 45, are tubular extensions that are monolithically joined between convexly-curved segmental side wall portions of chamber 29. Such extensions may, as desired, be either wholly isolated from the spaces 46, 47 comprising the chamber volumes, or alternatively provision may be made for access by a water door or the like (not shown) communicating between the interior of the vertical columns and the chamber spaces. Suitable passages may be provided in the upper portion of the chamber side wall, as at 48, whereby lines or conduits may be led down certain adjacent pillars 25 to the spaces in columns 45. Control chamber spaces, and particularly the interior spaces of columns 45 and central column 44 may be utilised during towage and self-righting, as will be described at a later point, for housing high volume rate pumps employed for ballasting the pier and for transferring ballast masses, since a significantly large internal space within spaces 46, 47 will remain unfilled until after the pier is righted or even until the pier stands on seabed.

Figure 3:
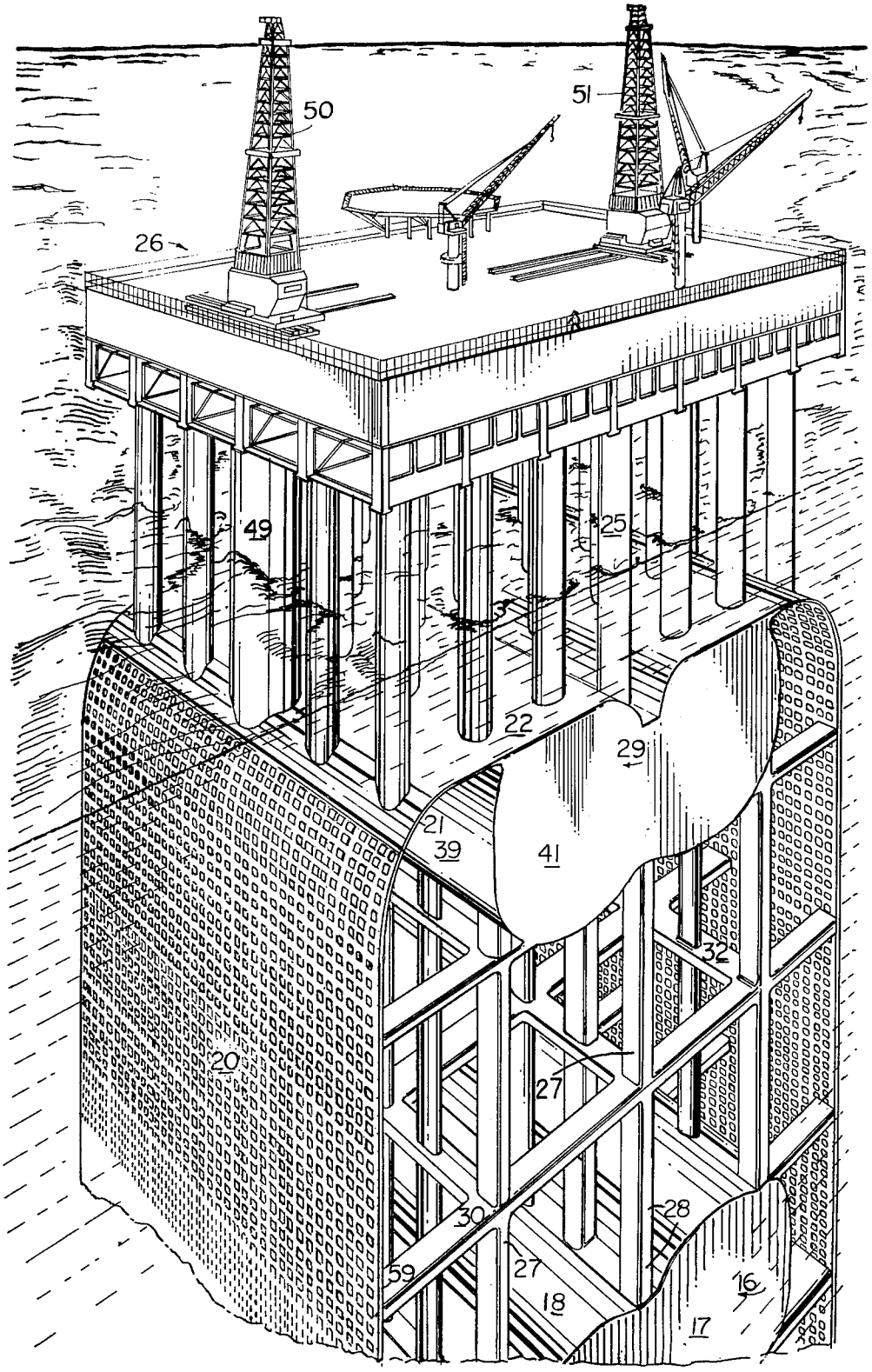
FIG. 3 is an aerial perspective view showing the pier of FIG. 1 carrying auxiliary deckwork in use for drilling and production of petroleum wells.

To accommodate a primary purpose for erecting a marine pier having a large petroleum storage capability, two further pillars 49 of large size may be provided, extending from the upper side of base slab 12 to the deckwork 26, between the flanking wall 20 and each side of container body 16. Each pillar constitutes a shielded drilling passage of diameter 20 to 30 feet or greater which does not communicate with any part of the container spaces 33–38 nor with the control chamber spaces 46, 47. These passages are formed as rigid cast concrete tubes, suitably reinforced and post-stressed by tensioned tendons emplaced circumferentially and along axial directions, for shielding the drill string as drilling progresses in cluster well drilling and to sheld oilwell casings leading from below the seabed to the deckwork. A large number of boreholes may be drilled from the deck through base slab 12, using derricks 50 and 51 as shown in FIG. 3 with guide rails 52 permitting the positioning of the rig above that sector of the drilling passage corresponding to the entry position of the borehole through base slab 12. Each drilling passage 49 is secured to the exterior of container side wall 18 and is monolithically joined with the flanking wall curved portions 21 at the piercing location. As may be seen in FIG. 2, a minor but useful space exists between the flanking wall and the nearest surface of the drilling passage, hence drag forces due to seawater jets are minimised.

THE CONSTRUCTIONAL PROCEDURE — INITIAL STEPS

The description which follows is directed particularly to the building of an illustrative embodiment of a marine pier according to the invention. It is to be understood that the specific dimensions are in no way limiting. For example the pier of FIG. 1, the constructional steps of which will be explained hereinbelow, may have a standing height of 760 to 800 feet above seabed, a breadth about 320 feet, and a width about 220 feet, intended to carry a superstructure at a height at least 60 feet above MSL. A flanged base having dimensions about 380 feet by 280 feet and a thickness of 7 to 10 feet carries a series of downwardly-projecting ribs 53 to aid in anchoring against lateral displacement.

The initial construction site is chosen primarily with regard to the availability of large amounts of concrete aggregates of high quality, the availability of a coastal area enabling cheap excavation and damming by local sediments, and adjacent or reasonably near deeper water of 160 to 200 foot depth which is sheltered from deep sea waves. The climate conditions at the site moreover should allow reasonably long storm-free construction intervals and absence of severe freezing conditions. A typical site as diagrammed in FIG. 4 has an off-shore sea depth about 30 to 50 feet above sediments 54 overlying bedrock or consolidated sediments 55, and a gently sloping natural seabed between land and deeper water. The first stage of construction is reached when a barrier 56 such as an interlocked fence of rolled-section steel piling has been driven into sediments 54 to form a perimeter enclosing a length of shoreline. Soil materials are then piled to form a barrage 57 on both sides of the fence of piling, and the seawater pumped out to leave a dry surface. After removal of materials to uniformly deepen the basin to the level of the barrage, followed by continuous pumping out of seepage, the actual fabrication is begun upon a shallow layer of crushed rock or gravel 58 smoothed to provide a level building site.

Referring additionally to FIGS. 7, 8, 9 and 10 the container end wall 17 is cast on a flat form with smooth upper surface (not shown) to provide a dense, smooth concrete surface which will be exposed to the sea. At the same time the base and base flanges are fabricated, preferably as a water-tight box to provide positive buoyancy, and the lower margins of the solid walls 14, 15, and of the flanking walls 20 are laid out, as well as brace wall margins 19. In providing molds for the lower margins of the flanking walls, the upper surface of the molds should be polished steel, to shape the outermost edge of the wall when standing as a smoothly rounded body. The composition of the concrete should preferably also be chosen and the casting conditions so regulated that a dense and durable mass is exposed to the moving seawater, along margin 59. Upon an initial "footing" the flanking wall is built up according to the manner diagrammed in FIG. 8, wherein the channels or ducts 23 are realised as precast sleeves 60 formed with integral square flange slabs 61 including faired entryways or openings 24, of uniform diameter, or nearly constant cross-sectional area. If the openings are cylindrical their diameter may be 3 to 4 feet, and the length between outside surfaces of the slabs may be 60 to 72 inches, depending on the wall thickness chosen for the portion of the wall.

Because the internal surfaces of the sleeves are subjected to unceasing motion of seawater, often at relatively high velocity of streamflow, it is desirable to specify a concrete mix which utilises a water/cement ratio of about 0.40, casting in polished steel forms with good vibration to ensure a very smooth and dense surface, absence of reinforcing iron, and a rich concrete mix, to achieve a concrete strength above 8,000 pounds per square inch when fully cured.

The building of the flanking walls proceeds by stacking the flange slabs to the specified axis-to-axis distances horizontally and vertically, preferably on a square grid in the vertical plane, placing heavy reinforcing steel horizontally and vertically between adjacent rows and columns of sleeves, placing tubes for receiving post-stressing tendons as indicated at 62 and 63 horizontally and vertically, clamping a formwork to close the ends of the spaces 64 as by horizontal and vertical dams 65 and 66 held by member 67, and placing a concrete mix to occupy the spaces about the sleeves and between the slab flanges. The concrete to be applied at the site should specify a 28-day strength of at least 6,000 psi. The mix should include a set-retarding additive to ensure that placement of the concrete about the perimeter of the pier, some 1200 feet of wall length, will be performed within the workability period. One successful combined set-retarding and air-entraining material is a sodium lignosulfate. The mix should be rich and highly sanded with equal parts of fine aggregate and coarse aggregate by weight, an aggregate/cement ratio of 4.0 and a water/cement ratio of 0.40. Usual precautions against too-low temperature (not below 50° F) must be taken.

At the same time as the flanking walls are being raised in "lifts", slip-forming of the non-perforated structural walls proceeds utilising a perimetral slip form such as is indicated in part at 68 in association with container side wall 18. The extent of the slip-forms required may be appreciated from FIG. 9 which indicates in horizontal section the concrete structure by dashed outlines, and horizontal and vertical tendon sheaths and tendons placed as the work progresses, by the solid lines and dots 69 and 70. Advantageously, the high-strength tendons should be inserted into metal tubing of smooth internal wall surfaces. The precise placement of the post-stressing members is not necessarily as shown by the drawing, and the diagrams are only illustrative of the general concepts of ensuring that no part of the completed structure will be subjected to tension loads. A typical arrangement places tendons as circumferential portions of loops following the curvatures of the container side wall 18 within the concrete, and anchoring in recesses opening into the spaces 33*a*, 33*b*, 34*a*, 34*b*, 35*a* and 35*b* at the junctions with the side wall of the walls 14 and 15 and the brace walls 19. Further loops of U-bend form may be placed with the "U" interlocking with the flanking wall as indicated at 71, the ends of the loop being anchored at anchors 72 recessed into the junctions of center upright wall 14 with the brace wall.

A series of looped vertical sheaths 70 may also be placed along the breadth dimension of the solid walls as may be seen in FIG. 8. Due to the fact that as the vertical height to which the walls may be built in the drydock is limited by the floating draft of the initial construction stage, and because this limited height must be coherent and self-supporting upon initial floating, it may be desirable to insert tendons and perform the hydraulic jacking of the lower circumferential group and part of the vertical tendons when the limit height has been reached, leaving inserted sheaths for future use with tendons to be inserted and tensioned as the structure reaches completion.

The control chamber 29 is constructed in a similar manner. The initial drydock stage is characterized by a large positive buoyancy of each container body portion, namely storage body 16 and the control chamber portion 29, whereas the external solid walls 14, 15, and 19 have large negative buoyancy, as do the flanking walls 20. To improve the buoyancy of the partial pier, a number of the lower tiers of the sleeves 60 are desirably rendered with a positive buoyancy by providing end caps 72 as in FIG. 7 fitted snugly by their margins 73 into the openings 24 and provided with water-tight sealing flanges or flaps 74. Such devices are intended solely for temporary improvement of buoyancy until the wall heights of the principal buoyant bodies 16 and 29 are such that the flanking walls may be carried without aids, at which time the caps are released and removed.

The vertical columns 27 are cast using slip-forms and internal scaffolding, and are joined together integrally and with the other structures. The lowermost tier of pillars 25 is cast using a base scaffolding 75 standing on the bed of the drydock, or, alternatively, each pillar may be precast and connected with the pier deck base 26 and the top wall 22. As the need arises to construct other vertical columns 27 and beams and braces 30, 32, further scaffolding is provided to support the horizontal extents of these tubular bodies, which are buoyant.

Figures 4, 5, 6, 7:
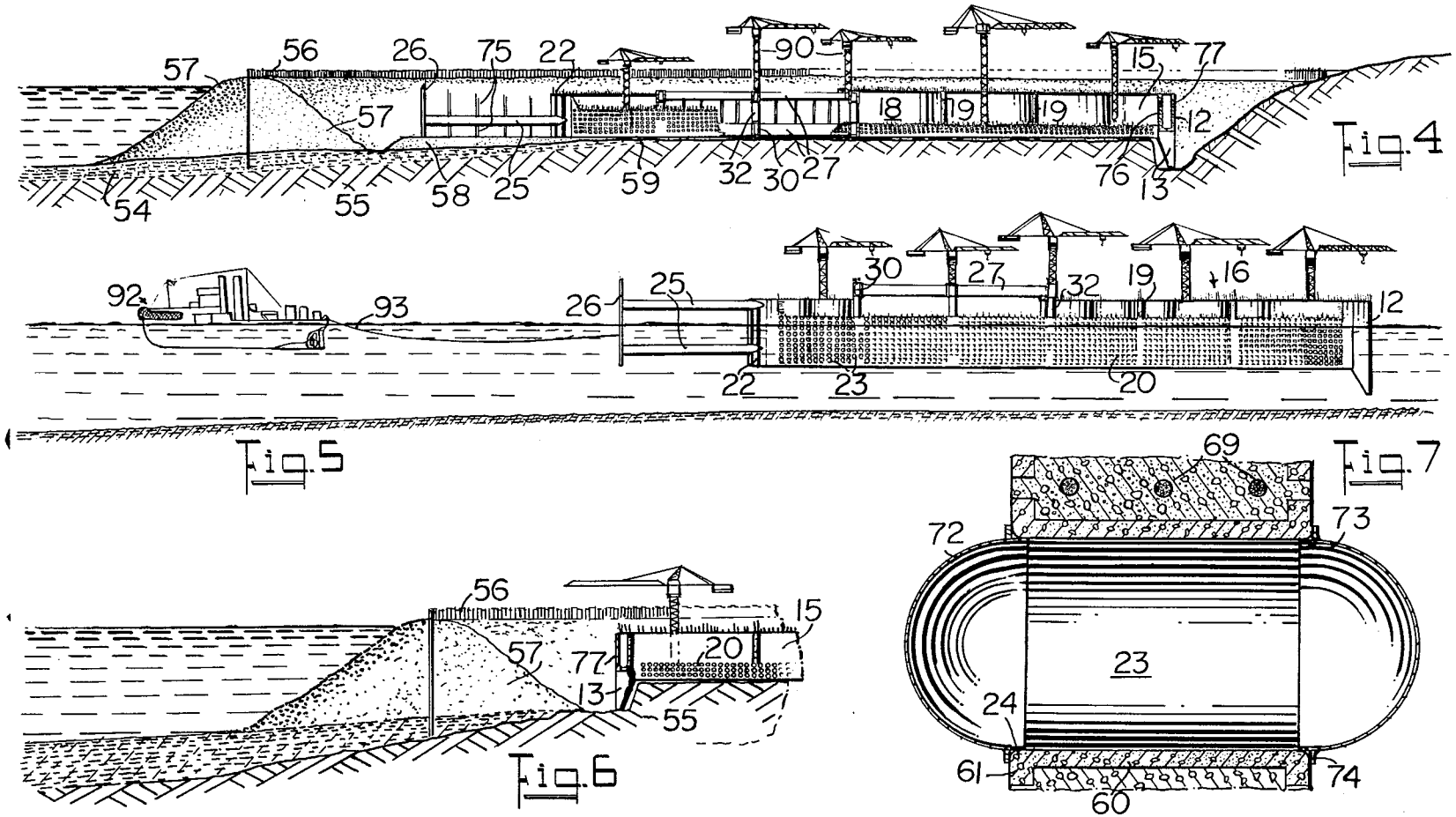
FIG. 4 is a side elevation view partly cut away showing initial fabrication of the pier progressing in a drydock adjacent the sea.
FIG. 5 is a side elevation view of the pier of FIG. 4 advanced in construction to the self-floating, towable stage, under tow to relocate in a deeper water protected sea area.
FIG. 6 is a side elevation view similar to FIG. 4 showing the pier with reversed orientation to facilitate floating when a large base flange must be incorporated.
FIG. 7 is an elevation view taken on an axial diametral section through a channel or duct of the flanking wall of FIG. 1 showing provision of end-caps for augmenting positive buoyancy of the initial drydock structure.

It is desirable to gain some positive buoyancy for the base slab in the drydock stage, to reduce the flooded height (draft) needed to clear the drydock bed, by constructing relatively thin face walls 76, 77 with cross walls (not shown) which may be the extensions of walls 14 and 15, to form an open box body.

Where a relatively narrow flange extension 13 is to be built the orientation of the pier indicated in FIG. 4 will be preferred since towage with top wall 22 forward is more convenient. Where a considerably larger flange is to be incorporated, the reverse orientation diagrammed in FIG. 6, with base facing seaward, is preferred, as the excavation required will be greatly lessened thereby, and a cut wall 78 may be advantageously used to assist in the casting of the flange.

The initial height of the container side wall and chamber side wall required may be, for example, 30 to 40 feet. At least two, and preferably three, of the seven tiers of vertical columns 27 will be erected and integrally joined with the associated tiers of braces 30, 32, with the container body 16, and with the control chamber portion 29, to assist in carrying the flanking walls, although where minimal enhancement of buoyancy of these has been provided by closing ends of only a few tiers of channels or ducts, walls 20 may be erected only to a height providing a bare freeboard. The end of the drydock stage is reached by admitting seawater to float the structure safely. At this point the barrage 57 is opened sufficiently to pass the pier in its lengthwise direction and sufficient piling 56 is removed to make a passage. The structure is carefully floated out to deeper, protected water as diagrammed in FIG. 5.

CONSTRUCTIONAL PROCEDURE-HORIZONTALLY FLOATING PIER

A mooring is provided (not shown) using any suitable means of anchoring to seabed and to adjacent land mass allowing for tidal rise and fall, in a depth of at least 140 feet, and preferably 200 feet or more, in a region of the sea where little or nil wave motion is experienced, and further erection of the pier proceeds until the vertical height of the construction has reached specified width dimensions of the pier components.

As the mid-width stage of the floating construction is reached the fabrication of the drilling passages 49 as integral members connected with the curved portions 21 of the flanking wall, with the convex outer surfaces of container side wall 16, with the brace walls 19, and with the base slab 12 is carried out by either of two principal methods. Tubular lengths of the drilling passages, of 30 feet diameter but of reduced wall thickness and in lengths such as to extend between and be embedded in, for example, a pair of brace walls 19, are precast and floated with the initial pier stage, the lengths being lifted into place on seats (not shown) in apertures in the walls through which the drill tubes extend. The walls of the closed-ended partly-submerged tubes 49 are thickened by casting concrete on their interior surfaces employing internal scaffolding and curved forms. Alternatively, scaffolding is erected utilising the horizontal tubular columns 30, the brace walls 19, and the container side wall 18 as supports for formwork in which the cylindrical drill passages are cast above water. Similarly the curved wall portion 21 of the flanking pair of walls and the vestigial deckwork 26 are utilised to carry formwork for the external potions of the drill passages.

All of the hollow tubular portions of the structure ennumerated are constructed with their internal spaces dry, so that substantial positive buoyancy assists in carrying the forward portion of the pier, while the sidewall height 39 of the control chamber 29 is not yet sufficient that this member can carry the forward portions having negative buoyancies — i.e., the vestigial deckwork, top wall 22, and elevated pillars 25 and columns 27. Once the control chamber has reached a given height as may be determined by calculations of displacement and structure unit weights, some water addition to selected container spaces may be necessary to trim to level.

The fabrication of the upper capping end wall 17 of the container body 16 and capping end wall 41 of the control chamber portion involves casting of a homogenous relatively-thick (i.e. 2 ½ feet) slab spanning distances of the order of 90 to 100 feet, parallel with the container or chamber base ends which lie 200 feet or more below, as may be understood by reference to FIG. 13. Moreover since upon immersion of the completed end walls during righting of the pier, portions of these walls may be subjected either to outwardly-directed or inwardly-directed loads resulting from pressure imbalance between internal gas pressure and the hydrostatic pressure of the sea, as when the upper internal spaces are not fluid-filled, prior to sinking the pier to seabed, no form of hatch in the capping end walls is permissible. To assure maximum strength and integrity, the capping end walls should be unitary castings without any flaw. Accordingly the fabrication of the upper marginal portions of the upright walls 14, 15, the brace walls 19, and the lobed sidewalls 18, includes the procedures of forming internal perimetral shelves or ledges 79 about 10 feet below the upper limits of these walls, as may best be seen from FIG. 14.

The arrangement of scaffolding beams 80 which may be of girder form, having their ends resting on ledges 79, permits supporting thereon the sets of formwork-carrying girders 81 spanning distances considerably less than the wall-to-wall span, for example 30 feet in length, to form a support structure of low deflection under load. A system of posts 82 supported on the girders and beams carries a smooth-surfaced formwork 83. Upon casting of the end wall 17 to the required thickness and following the setting of the concrete slab, the scaffolding and formwork may be removed along the ledges 79 and withdrawn through the uppermost vertical column 27 through apertures 84 formed in the lower end 28 of the column at its junction with the container side wall on either side of the load-carrying wall 14. Other vertical columns 27 of the uppermost tier may similarly be utilised.

The provision of the upper ledge 79 and the other ledges 85 at the intermediate and at a lower level facilitates erection of any scaffolding during slip-forming, finish treatment of the internal container surfaces as desired, and the anchoring of the ends of tendon groups placed as vertical loops. For example, certain tubes may be placed providing a U-loop embedded in the upper capping end wall 17 and its open ends accessible in recesses 87 at the lower side of a junction of the lower ledge 86 with a wall such as 14. It should be noted that the curvatures of the U-bends of tubes in which tendons are placed should be of the order of 4 feet radius, or more.

Following the removal of all temporary structural material and debris, any access apertures 84 are hermetically closed by casting processes. The provision of large-section ducts such as 88 within an internal upright wall such as 14 or 15 and communicating with spaces 33*a*,*b*–38*a*,*b* by suitable gates (not shown) in sufficient number to provide for high volume rate transfers of fluid, connecting with steel tube conduits (not shown) ascending within tubular columns 27 to the surface or to the control chamber spaces 46, 47, affords isolated and shielded means for carrying a potentially polluting fluid such as petroleum. Any pumps, motors and control and power lines (not shown) will be placed within the spaces of container body 16 and of control chamber 29 and any jet pumps served by hydraulic lines from the deckwork also fitted prior to casting of the closing wall portion. The spaces in all tendon sheaths and anchors are grouted.

Figure 13:
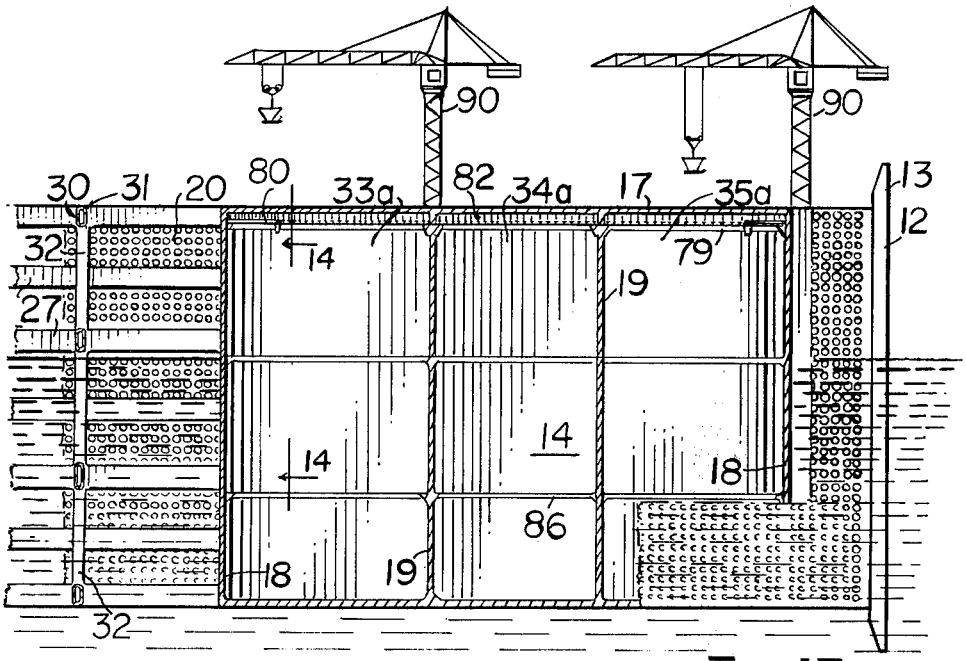
FIG. 13 is a side elevation view partly in section showing the projection on a vertical plane at the position of line 13—13 of FIG. 2, but rotated into the horizontal erection stage and showing casting of the container end wall.
Figure 14:
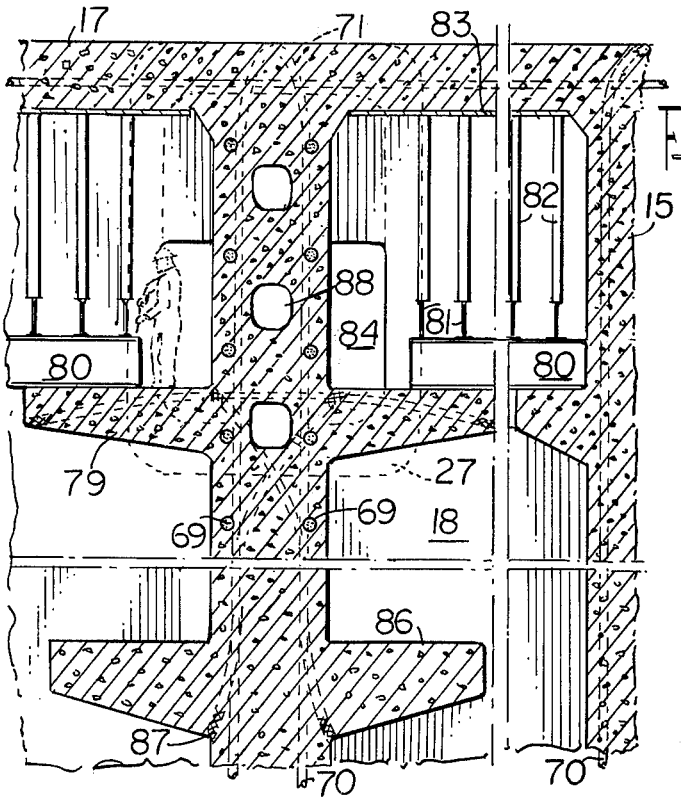
FIG. 14 is an elevation view of the section designated by line 14—14 of FIG. 13 looking into the central column and showing casting of the container end wall.

The structure on completion has a relatively large freeboard as diagrammed in FIG. 13. As desired, the freeboard may be lowered to about 40–50 feet or as adequate to withstand any wave height likely to be encountered during towage of the pier to a distant site, by pumping into selected spaces 33*a*,*b*–38*a*,*b* a sufficient volume of seawater. Although the vessel has good stability in roll without ballasting at its shallower floating drafts, loading of the lower portions of the container's internal volumes further improves the lateral stability about a longitudinal axis. Appropriate trimming ballast may also be placed in the lower spaces of the left and right control chamber spaces 46, 47.

At any stage of the construction after the positive buoyancies of the two main buoyant bodies — control chamber 29 and main container group 16 — have increased sufficiently, the capping members 72 may be removed and recovered as by divers working under water, either admitting seawater to displace trapped air, or increasing internal air pressure to dislodge the caps. Preferably such capping members should have a slight positive buoyancy to facilitate recovery.

As the vestigial deckwork 26 is fabricated to complete an interconnected grid of beams integral with the ends of pillars 25, there may advantageously be mounted, as upon an extension of a central uppermost pillar 25, designated 89, any superstructure necessary for supervising towing, ballasting, trimming, self-righting, and sinking of the pier after it leaves the final construction site. Such equipment as a form of crane 90 including living quarters, supplies, power plants, communications equipment, and so forth, housed in a waterproof box 91 may be fitted, thereby facilitating subsequent erection of the deckwork.

THE PIER AS A SEA-GOING VESSEL

Figure 19:
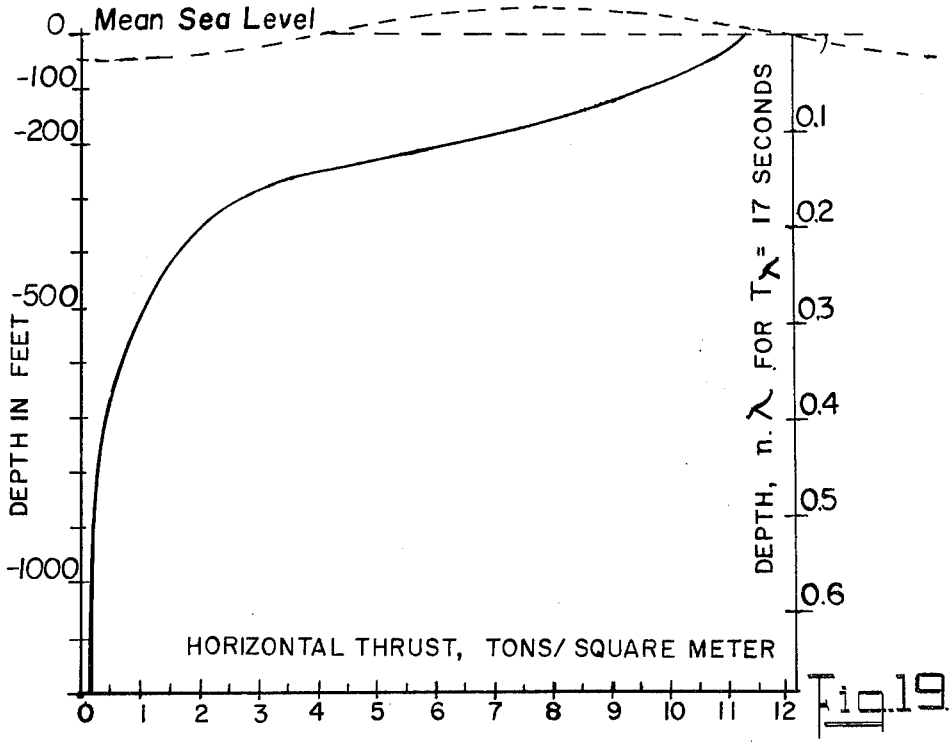
FIG. 19 is a graph depicting horizontal thrust forces acting on vertical surfaces due to seawater movement corresponding to a wave of amplitude $(2a)=100$ feet at various depths.

The sea-worthiness of the large pier structure in its horizontal attitude has been found to be excellent by model studies working with equivalent waves of large amplitude. In the delivery of the completed pier across an ocean distance which may exceed 1,000 miles the journey may require a week or longer to complete, even at the towing speeds of several knots possible for the structure when under tow by powerful tugs. During such extended interval of time all possible states of sea and weather may arise. The relatively fragile structure is capable of maintaining its structural integrity despite the application of periodic lateral thrusts of great magnitude from waves abeam, for example about 40,000 tons when a great sea is running broadside to the length of the vessel. The entire submerged portion of the structure, which may for example be about 150—165 feet in vertical extent, lies in the surface layers of the sea in which particle orbital velocities and wave pressure forces are at near-maximum values. For a long-period wave (12 to 17 seconds, for example) capable of propagating with an open-sea amplitude which may exceed 75 feet, the extended length of the pier represents a half-wavelength or more, hence the coupline of wave energy with the structure may be expected to be severe. Reference may be made here to the graph, FIG. 19, illustrating forces exerted on a reflecting vertical surface of large dimensions for amplitude $2a = 100$ feet. The flanking walls 20 are designed and positioned to serve not only as a "hull" for the pier as a sea-going vessel, but also to decouple incident waves and to minimise the reflection of wave energy that would give rise to amplitude increase. Whereas up to the present time stationary breakwaters have been constructed for performing a similar function with respect to a rearwardly-spaced unperforated wall, the flanking walls constitute a moving floating breakwater including the massive container body 16 and control chamber portion 29 spaced horizontally from and disposed between a pair of generally parallel perforated outer walls. A number of interesting properties have been found for the association of such pair of perforated walls with an extended rigid large non-perforated interior structure when under tow. Surprisingly, a greatly lowered horizontal drag is experienced for varying sea states, when the vessel is towed with top wall 22 forward, as a bluff bow. The usual bow wave appears to be greatly diminished in amplitude. A fine-pattern turbulence is generated in the seawater adjacent the sides of the flanking walls 20, that tends to disorganize and dissipate the energy of incident waves. The vessel has an extremely long pitching period, and has high stability about any horizontal transverse axis.

On arrival of the pier over the final site, the freeboard is deliberately considerably reduced, for example to less than 10 feet, as shown in FIG. 15 and FIG. 16, which diagram in phantomeoutline the projected elevational areas of ballasting water volumes pumped into the intermediate main volumes 34*a*, 34*b* and into the lower main chamber volumes 35*a*, 35*b*, and also into associated segmental volumes 37*a*, *b* and 38*a*,*b*. Preferably, fluid is introduced concurrently into all submerged container and chamber spaces to provide substantial internal hydrostatic pressure offsetting the pressure exerted by the sea on the external surfaces. It is crucially important especially when the pier is being turned into upright attitude, as will be discussed next, to avoid dangerous imbalance between the internal and external water pressures acting on any part of the structure. The end wall portions of the container or container group particularly should not be subjected to excessive loading, as would occur if insufficient water column is provided in communication with internal spaces bounded by such end wall portions.

TURNING THE PIER INTO UPRIGHT ATTITUDE

As a preliminary to the righting procedure, studies will be made to ascertain the distribution of displacements and masses required to ensure that the group of pillars 25 of the pier of FIGS. 1 and 3 may be safely elevated out of the sea with minimal root stresses at their junctions with the top wall 22. Since the group comprises relatively slender columns, e.g. with diameters only 10 to 15 feet, of hollow shell walled form and with lengths exceeding 120 feet, it will be apparent that the moments acting on a transverse section at the base for an individual pillar supporting its share of the deckwork would give rise to excessive compressional stresses, if the pillar were to be held horizontally in air as a cantilever beam. However, when the righting rotation is effected about an axis relatively near to the top wall 22 and sufficiently under the sea so that the uppermost group of pillars is inclined to the surface of the sea on rising therefrom, and the righting rotation then proceeds so that subsequent tiers are further inclined and so that the majority of the tiers come into the air with inclinations to the vertical of 45° or less, the sharing of loads by the member pillars is achieved safely despite small wall thickness at their basal junctions, by reason of their free ends being tied together by vestigial deckwork 26. In addition, the great beam depth represented by the two drilling passages 49 fixed at their upper ends in deckwork 26 and integrally joined with top wall 22 contribute a low-deflection, strong support structure for the pillar group. By virtue of the positive buoyancy contributions of the upper portions of the drilling passages — above the top wall 22 — and the small positive buoyancies of the submerged but unfilled pillars 25, relatively slender and thin-walled pillars may be used in the pier when the righting rotation is carried out as described.

FIG. 15 illustrates the various gravity loads, namely trim ballast WT, the structure dry weight WS, the container body ballast WB, which are in equilibrium with the single composite buoyant force B associated with the mainly immersed floating pier structure. It will be noted that the greatest single gravity load WS acts through mass center $CM_S$ which lies in the container body just to the left of upper brace wall 19, also that a relatively large fraction of the volume of control chamber portion 29 is occupied by trim ballast.

To bring the pier into incipient self-righting state, as diagrammed in FIG. 16, while also assuring that the righting rotation will be about a horizontal axis within the control chamber close to top wall 22, the basal portion of the pier is first immersed, to bring the container body 16 almost wholly under the sea surface. For example, the MSL intersects the capping end wall 17 at point *m* which lies a distance *x* horizontally from the line of action of buoyancy vector B, and the end wall is inclined to the horizontal by the angle $\theta$. This is achieved by increasing the ballasting of container spaces 34*a*, 34*b* and 37*a*, 37*b* to their limit, which adds mass relatively near to $CM_S$, and also further ballasting the lower compartments 35*a*, 35*b* and 38*a*, 38*b*, for example to approach or even exceed half-filled state. The buoyancy vector B shifts slightly as a consequence to the right, i.e. toward the base, acting about a buoyancy center CB which is slightly higher than as diagrammed in FIG. 15 and closer to $CM_S$ in horizontal distance. The pier is stable, with the composite mass center CM lying vertically under CB and the total mass vector $\Sigma W$ being equal to buoyancy vector B. In this state the uppermost tier of pillars 25 and extension column 89 are elevated partly above the sea. Any further ballasting of the lowermost container compartments 35*a*, 35*b* and 38*a*, 38*b*, i.e. those spaces nearest base slab 12, will not be equalled by increased displacement because as the basal end sinks further, distance *x* will decrease, while angle $\theta$ tends to increase, the composite mass center W being shifted to the right with respect to center CB.

At a critical point, as the ballasting load increases in the lower compartments, an irreversible loss of horizontal stability occurs, as center CM moves toward the base and the righting moment arm (the horizontal distance between the direction lines of vectors B and ΣW) increases. Ideally, a small ballast mass should be transferred once angle $\theta$ is suitably large, to decrease WT acting through the control chamber, and added to the lower container compartments. Such transfer may be accomplished without the use of pumps of great capacity, merely by connecting a channel to serve as a conduit for conveying the fluid volume of the trim ballast therealong to flow into the container body spaces as additional ballast. To this end, there may be provided suitable gates or valves (not shown) located at the junctions of a pair of columns 27 which are closest to the more deeply-submerged end wall 41 with tubular passages 45, as may be understood from FIG. 12. By such arrangement, the flow of seawater out of the control chamber portion 29 will be along continuously-extending conduits including passages provided in container body 16 as along load-carrying walls 15, 15, to lead the ballast into the selected lower compartments of the container body. Such passages (not shown) may be understood to comprise internal spaces extending in the length direction of walls 15, 15, similarly to passages 43 depicted in dividing wall 40 in FIG. 11. Such internal spaces would be arranged to open by suitable ports (not shown) into the container body 16 spaces. When the flow cross-section is sufficiently large, e.g. 20 square feet or more particularly where two conduits are provided, the hydraulic head between the ends of the conduit when the basal end has sunk only 10 to 20 feet below the sea assures rapid ballast transfer, requiring less than one hour, the rate being entirely controllable. A steadily increasing rotational velocity is imparted to the pier, further sinking the basal end, which rotation is highly damped due to the large cross-section of the container body. At the conclusion of the rotation, i.e. through an angle $\theta = 90°$, the pier will be in the vertical, and will float stably as illustrated in FIG. 17 with the pillar group 25 largely or entirely clear of the sea, and the container body spaces being largely filled with seawater and any head spaces under hydrostatic pressure, while the spaces of the control chamber portion may be largely or entirely free of water. Stability in this floating state is ensured by the relationship of total buoyancy vector ΣB acting through center CB which is displaced vertically well above the mass center $CM_S$ of the dry structure and above the composite mass center CM through which the composite mass vector ΣW acts. In this state, the pier may be towed, as indicated by tug 92 which has a towline 93 secured to the drilling passage on one side of the pier, while another towline or lines 94 may be secured to the other passage 49 or other pillars for the purpose of accurately positioning the pier, or even moving it some distance under tow.

BALLASTING AND PRESSURIZATION OF CONTAINER SPACES

When the pier is being righted and the transfer of water ballast into the spaces in the submerged container body is under way, those compartments not occupied by seawater will be filled by air which initially is at substantially atmospheric pressure. Such head space will usually be a fraction less than one-half the total container volume, as may be seen in the elevation diagram, FIG. 17, located about midway between the pier base 12 and MSL and comprising parts of spaces 33a,b and 36a,b.

Referring to FIGS. 20*a* and 20*b* the sea pressures exerted on the exterior surfaces of the container body represented by the simplified single vessel 16′ provided with a vertical transfer conduit 27′, may be seen from the graph to range from about 237 psi ($p_1$) at the lowermost part of the body, to about 132 psi ($p_2$) at the uppermost part of the body, these pressures being read at abscissa intercepts 96 and 97 corresponding to depth positions respectively of about 540 and 300 feet. Graph line 95 depicts the nearly linear increase of hydrostatic pressure of the sea with depth, reaching about 440 psi at 1,000 feet.

In the absence of compensating internal pressure acting on the inner surface of the container body, destructive loading of the structure would result, particularly overstressing of planar end walls which may crack or even collapse inwardly. If, however, a column of seawater is held in conduit 27′ extending from the lowermost part of container body 16′ and terminating near the sea surface, the column being continuous and communicating with the water ballast within the container, air trapped in the head space will be at the pressure $p_0$ equivalent to the hydrostatic pressure of the column height above the ballast mass, as indicated by abscissa intercept 98. Such columm pressure will cause virtually identical internal and external pressures to be exerted on those portions of the container walls ranging in depth from the ballast level to the lowermost extremity.

Since all parts of the gas volume trapped in the head space will be at the same pressure $p_o$ (where $p_o > p_2$), it will be apparent that the container walls above the ballast mass will be subjected to internal pressure greater than sea pressure, the imbalance being greatest at the top of body 16′.

Provided that such excess internal pressure is tolerable for the structure, the condition may be permitted for some or all of the time during which the pier remains in upright floating attitude. Where the vertical extent of the head space may be such that gas pressure imbalance would be unsafe at the top of body 16′ the head space pressure may be controllably reduced, thereby setting up a constant sea pressure excess on the walls along the height of the ballast mass, which excess is within a safe limit. A lesser sea pressure excess will also be set up over some part of the wall extending above the ballast level, decreasing to zero, above which point an excess internal gas pressure will exist, increasing to a safe value at the uppermost part of body 16′ Such reduction in gas pressure may be effected by simultaneously pumping water from the upper part of conduit 27′ and venting gas by way of a control conduit such as 99 via valve V to maintain a constant ballast level.

While the foregoing has dealt with pressure balancing for the righted pier, in which the greatest risk of overstressing would attend due to the greater sea depths involved, precautions must be taken that at every stage and inclination during the righting rotation of the structure is not subjected to unsafe pressure differences In the actual pier, depending on the initial volume of the head space, as the inclination of the pier increases following the beginning of the righting rotation, control ballast water will flow along the conduit, compressing the air held within the head space. Provided that the volume of control ballast available from the control chamber portion 29 is sufficient so that there is a continuous filling along the length of the transfer conduit, at all attitudes including upright state, substantial pressure equalization may be achieved or at least satisfactory compensation realized.

When a pier is to be sunk to stand on seabed, the admission of further water ballast into the container body spaces should preferably proceed so as to ensure acceptable pressure balancing as described, as by pumping water into the upper end of the transfer conduit and simultaneously decreasing the gas pressure in the head space at a suitable rate so that water may enter and occupy all container body compartments.

When at any time it may be desired to refloat the pier the same precautions should be taken that the removal of any water ballast particularly from the main storage container compartments does not cause an excessive pressure imbalance, such removal of water ballast preferably being accomplished by the method of forcing a gas or air under pressure into the container spaces to be emptied, and discharging the water ballast through a continuous transfer conduit leading from the container to near sea surface, the gas pressure being maintained so long as the pier remains in erect floating state.

STANDING THE PIER ON SEABED

The final step of increasing the weight of the pier so that it sinks to the ocean floor 11 is carried out as a continuation of the initial ballasting operation, performed either from a service craft alongside (not shown) or by means of equipment installed in the building 91. The great mass of the ballasted pier, which may for example be 500,000 to 600,000 tons weight, or more, assures a slow descent, further damped by the cushioning effect of the water under the base slab as the distance to the seabed decreases to a few feet.

With a distance of only about 60 feet to sink, and at the limited velocities of descent resulting from the conditions stated, the final settling on seabed will cause little shock; as the base ribs 53 come into contact with sediments 54 the kinetic energy of the pier will be largely spent in expelling a thin layer of water and in penetrating and plastically deforming the sediments by embedment of the ribs. Once the ribs are engaged with the seabed 11 the pier can resist forces tending to slide it laterally, i.e. surface winds and/or ocean currents at the site. It is however desirable to rapidly increase the ballast mass and to fill the container spaces entirely with seawater, to maximize weight vector ($W_S + W_B - B$) acting through the ballasted mass center $CM_B$. The filling of all tubular members of the pier structure, namely the drill passages 49, vertical columns 27, braces 30 and 32, and the control chamber portion 29, augments the gravity load.

MARINE PIERS FOR VERY DEEP WATER SITING

Referring to FIG. 21, a pier 100 is shown intended for siting at a depth which may be a major fraction of the wavelength of a wave of 17 second period. The pier is generally similar to pier 10 described and shown in FIGS. 1 and 3, except that the width dimension (along the container axis) may be enlarged significantly and the container body 116 is sixteen-lobed, for example, as compared with 10 lobes shown in the former, and has considerably greater storage capability for example 5 to 7 million barrels. The pier is relatively longer (i.e., higher) in proportion to its breadth dimension (transversely of the flanking walls). Load-carrying walls 14 and 15 may be significantly reduced in height to gain in storage capacitor where the relief channel cross-section necessary to reduce under-pressures resulting from wave incidence normal to the container end walls may be safely decreased. The lower portions of flanking walls 120 are set at slightly greater spacing and their upper portions have an increased inward inclination, while the upper compartments of the container body are shaped for a reduced breadth to provide jet-dissipating clearance distance from the adjacent perforated flanking walls. Drilling passages 149 pierce the flanking wall at a lower depth, and extend upwardly at greater horizontal distance from each other. The structure includes a number of transverse brace walls 119, and may carry a superstructure or deckwork 126 comprising several levels, at about the same minimum clearance distance above MSL as for the pier of FIG. 3.

As shown, a considerable number of well casings 101 may be placed in the group of boreholes drilled below the base slab from the drilling passages, these flaring with depth to reach areas of a producing reservoir rock 102, in known manner.

STABILITY OF SEABED-SITED PIER STRUCTURES

Reference should be made to diagrams FIGS. 22 and 23 relating the horizontal and vertical forces acting on the pier, represented by vector arrows $F_H$ and W, and the reactions of seabed soil materials with respect to the base slab.

Considering first the more uncertain condition where the resistance to downward pressure and to horizontal loads may be provided by soils having some plasticity and limited bearing strength, a varved marine clay or clayey silt bed 54 is diagrammed in FIG. 22 as supporting the base slab 12, through which the resultant vector R acts at the angle $\phi$ with respect to the vertical, intersecting the soil surface at the offset distance $e$ from the mid-position of the base dimension $b$. As a generality, the shear strength of test samples of such soils obtained under conditions causing as little disturbance as possible to the coherence of the materials provides little reliable indications of the behaviour of a large section of the seabed to great forces of periodic variability.

Because the resultant is eccentrically directed, the distribution of the soil reaction vertical components $p_1 - p_n$ will be non-uniform; for the example diagrammed, the vertical shear diagram will be of trapezoidal configuration, i.e. $p_n$ will be the greater unit reaction force at the edge of the slab base nearest to the intersection by the resultant R. Evaluation of the magnitude of such reaction force is useful, since an arbitrary maximum safe vertical shear force can be adopted. The ratios of $p_n$ to $p_1$ can be found by solving for the truncated triangular shear diagram of which the composite vertical reaction $F'_V$ acts through the centroid, yielding, $$p_n = \frac{2\,F'_V\left(2 - 3\,\frac{z}{b}\right)}{b}$$

where $z = b/2 - e$, and $e$ = eccentricity, i.e. ratio of offset distance to base length. The permissible eccentricity $e$ for a rectangular support slab is equal to or less than $b/6$.

Considering next the resistance to sliding, an arbitrary coefficient of frictional resistance may be derived from the test shear strength "S", such that:

$$\text{frictional resistance} = \text{Base Area} \times C$$

where $C = (\pi+2)S$.

Values of shear strength "S" for saturated clay soil may be below 500 pounds per square foot.

The safety factor in sliding is determined as $$\frac{C \times \text{Base Area}}{F_H}$$

In the case of a packed hard sand soil, the classical analysis involves determining the friction angle. For example between a sand seafloor 11 and a flat concrete slab, the friction angle may be 31°, i.e. if the slab were standing on a packed sand surface inclined at this angle to the horizontal impending motion would begin were the angle to be slightly increased.

The inclination $\phi$ of the resultant is computed, such that $$\phi = \arctan \frac{\Sigma^F H}{\Sigma^F V}$$

Assuming that the ratio is 0.18 ($\phi = 10° 12'$) the safety factor against sliding would be found as $$\frac{\tan 31°}{\tan \phi} = \frac{0.6}{0.18} = 3.33$$

In general, a factor of safety of 2.0 is sufficient.

The foregoing analyses have been shown by way of illustration of their application to actual conditions at a site. Poor seabed materials may require considerably enlarged base slab supports and rib and beam reinforcement of the extensions, In order to reduce to a safe value the magnitude of $\Sigma^F$H on the end walls of the container group, the total areal extent and its disposition in depth must be restricted to meet the design requirement, locating the larger end wall areas in deeper water and keeping the end wall area of a control chamber portion relatively small. In order to reduce to a safe value the magnitude of $\Sigma^F$H on the flanking walls, a higher lateral spacing of these walls from the container group and a higher perforation ratio may be required, e.g. up to 35% or even 40% to minimise reflection and consequently to avoid the greater thrust forces that would be exerted by amplitude increase of incident waves.

As shown in FIG. 24, one form of modular construction unit for fabricating the flanking wall with improved perforation ratio has a channel cross section bounded by straight line portions of a square, and arcuate joining corner portions. Such unit, for a given axis-to-axis placing pattern, does not permit the wall to carry as much load as when a circular-section unit giving a smaller perforation ratio is employed due to the lesser amount of concrete supporting vertical load, unless the axial length is correspondingly increased.

A PIER FORM FOR RELATIVELY SHELTERED SITES

In FIG. 25 a further form of pier designated 200 is shown in end elevation view having a main container body 216 of volume and form essentially identical with body 16 of the pier of FIGS. 1 and 3, but having its upper structure modified to utilize an economically advantageous fabrication method that does not cause excessive horizontal thrust loads to be exerted when the pier is impinged by the maximum-amplitude wave and greatest current velocities predictable for the site. Such sea states must be significantly less severe than those controlling the design of the pier of FIGS. 1 and 3, which is intended to withstand the most severe wave conditions, i.e. exposure to ocean waves of "infinite" fetch predictably likely to attain amplitudes of 100 feet or more.

In the pier form of FIGS. 1 and 3, that part of the loadcarrying structure extending from just below the lowest wave level to just above highest wave reach has been constructed as a novel arrangement of a forest of slender uniformly spaced pillars 25 having their root ends in a transverse top wall submerged about 60 feet below MSL and their upper ends tied by a gridwork of beams 26 on which a deckwork and superstructure is erected. While there are inherent difficulties in the fabrication and monolithic integration of such forest group of pillars with the other pier members, since the slipcasting processes of upward wall building which are practicable and efficient for the greater part of the pier structure cannot be used, the coupling of wave energy with the pillar group is much less than for any upright wall form.

It has been found that the horizontal thrust exerted by seawater undergoing wave motion of large amplitude on the pillars arises mainly due to drag phenomena, but is of a magnitude considerably less than would be accounted for by the total projected elevational area of immersed pillars, as where the pillars were standing in a single rank at right angles to the wave propagation path. The pillar forest serves as an excellent converting means for changing the energy of deep sea gravity waves into vortexial motion and ultimate dissipation of kinetic energy into heat, with low drag. This may be understood by considering that with waves propagating normal to the plane of the flanking walls, with the crest of a theoretical or ideal single-period wave arriving at the forward rank of pillars, the orbital paths of seawater particles are momentarily horizontal, with average velocity of the seawater flooding through the vertically-elongate channels defined by adjacent pillars somewhat greater than the open-sea orbital velocity for the given wave amplitude. A very low reflection coefficient due to the small ratio of pillar diameter to wavelength would slightly increase the particle velocity. However, in accordance with classical hydromechanics the flow pattern behind a cylindrical obstruction with axis normal to the flow direction of a fluid is highly unstable, the wake being characterized for flow not persisting a long interval of time by very regular individual vortices formed on either side moving with the fluid as two parallel rows, the rotations of initially-paired vortices being opposite, and the vortices becoming staggered along the wake in symmetric arrangement. The vortices are separated by laterally oscillating streamlines. Such vortices do not mix with the outer flow and are dissipated by viscous friction only after a substantial time has elapsed. Moreover the vortices move along the direction of flow with a velocity which is less than the flow velocity of seawater relative to the fixed pillars. Obviously, the relatively-enduring vertical-axis vortices in the Karman trails behind each pillar represent a substantially complete conversion of wave energy, analagous in its results with the function of the perforated flanking walls.

For almost every direction of wave propagation toward the pier, wave energy can propagate only a short distance within the pillar forest before the energy conversion is substantially complete. Some energy of waves whose propagation paths are parallel with the grid lines of the pier position pattern may move through the pillar group without conversion; the lowest drag loads are experienced for such special wave incidences.

In the pier form of FIG. 25 the flanking pair of walls 220 rise from the slab base 212 and extend through the MSL, curving toward each other as wave-washed portions 221, which merge with horizontal transverse top wall 222 above highest wave reach. The flanking walls, the curved portions 221 and the top wall 222 are all perforated as described for walls 20 of the pier of FIGS. 1 and 2.

A control chamber portion 229 which is separate from and spaced above the principal container body 216 is located in the upper part of the pier's load-carrying wall and column system, which comprises tubular columns 227 rising from the upper sidewall surfaces 218 joined by transverse tubular brace beams 230 and further brace beams 232 (not shown) corresponding to similar members of the pier of FIGS. 1 and 3. Control chamber portion 229 is of a volume and end area smaller than portion 29 of the previously described pier forms but yet has a buoyancy and transfer ballast capacity adequate for righting and for stable upright flotation, and has its side wall 239 spaced about 60 feet from MSL. In a pier intended to stand in a depth of about 600 feet, portion 229 may have four lobes, and be intersected by one horizontal transverse brace wall 219. Three load-carrying walls rising above control chamber portion 229 comprise perforated wall pair 215' spaced on opposite sides from wall 214', these walls being in vertical alignment in the standing pier with the lower load-carrying walls 214 and 215, and are integrally joined with intersecting transverse bracing wall 219', which is also perforated. It is to be understood that the form and pattern of the perforations conform to the channel distribution previously described for walls 20 for achieving large mass transfer under low hydraulic head, the flow through the perforations being constrained to issue as guided jet streams. The load-carrying walls 214' and 215' and transverse wall 219' may be of relatively lesser thickness than flanking wall pair 220. A suitable conduit or conduits 227' are provided integral with central load-carrying wall 215', extending upwardly from a junction or junctions with a centered column 227 intersecting control chamber portion 229. Top wall 222' carries a group of short posts 225, a significant number of which rise from the top ends of walls 214' and 215' and carry a deckwork 226 which is erected following standing of the pier on seabed. Such deckwork may be placed as preformed large sections, the work being relatively unhampered by the perforations of the top wall, which can be covered once the pier is erect.

Such pier form is constructed in a manner identical with that described for the pier of FIGS. 1 and 3, except that a considerably greater linear length of formwork is offered for simultaneous slip-forming concrete casting operations. The economies of scale make the construction more efficient, and at lower cost, while the pier may be completed in a shorter time.

The vessel represented by the horizontally-floating, towed stage of the pier has a lower drag with topwall forward than pier forms previously described, due to the reduction of bow wave amplitude and the low reflection of sea waves encountered.

When the pier is sunk to stand on seabed, its breadth dimension is preferably aligned with the sector of the ocean including the propagation paths of the larger-amplitude waves known to be likely to impinge the pier. In such orientation, flanking walls 220 and the system of perforated load-carrying walls 214' and 215' act as an efficient wave energy dissipative structure in accordance with the patent earlier referred to, for wave motion in the upper layers of the sea. The submerged side wall 239 of the control chamber portion provides an equivalent to the unperforated wall member of a breakwater having its seaward wall spaced from a solid wall. Such pier will be stable, i.e. free from risk of sliding or rocking provided that the lateral thrust directed into the structure by a wave of the largest expected amplitude does not exceed a predetermined magnitude, calculable by the methods previously described; in general such pier will be sited only where wave amplitudes are below 100 feet.

It is also feasible to utilise the pier form of FIG. 25 in any orientation where not incident wave from any azimuth will ever exceed some lesser amplitude, such as about 60 feet, and the wave thrust forces exerted on the end area of control chamber portion 229 and on the end area of storage container group 216 are within magnitudes permitted by the width dimension of the base slab. Since the pier width will usually not exceed about 225 feet, the maximum permissible wave amplitude combined with ocean current forces acting in the same direction as the wave forces, and maximum wind force on superstructure, may be found for a specific pier by the methods described for FIGS. 22 and 23, to locate the intersection of the seabed reaction vector within about 35 feet of the midwidth point of the pier base.

It is to be noted that wave coupling with the upper pier structure is accounted for nearly entirely by the area of end wall 239 when the wave paths are aligned with the container axes, the walls 214', 215', 219' and 220' having only narrow edge profiles and having only low drag forces exerted thereon.

STORAGE PIERS OF CONTINUOUS CONTAINER GROUP FORM

In FIG. 26 a pier designated 300 according to the invention provides extremely large storage capacity, the single storage container 316 comprising a continuous compartmented body extending from the base or from just above the base 312 to near sea surface, being intersected by upright load-carrying parallel walls 314 and 315, and by regularly-spaced transverse brace walls 319 connected with flanking wall pair 320. The specific structure diagrammed has sixteen lobes in its sidewall 317, which number will be increased or decreased for higher or shorter piers of this form depending on site and sea states. A suitable number of the uppermost compartments serve as control chambers, as previously described for other pier forms.

The upper structure of the pier corresponds with that described for the pier of FIG. 25, in that perforated upward extensions 314', 315' of the load-carrying compartmenting walls carry the perforated top wall 322, which is merged with the flanking wall pair 320 by curved joining portions 321 above the sea.

Because such pier form has a greater end wall area than any of the other pier forms described, when an end wall 317 is exposed to waves of given amplitude it will be subjected to a significantly greater lateral thrust force, directed at a point further above the base, hence creating a larger rocking moment or overturning moment. At the same time, due to the greater dry weight of such structure for a given pier height, the net submerged weight when filled with ballast and/or petroleum will be considerably greater than in other pier forms. To improve the stability of the pier, a large increase in the submerged weight may be effected by placing a mineral ballast such as gravel in selected lower compartments, the internal hydrostatic pressure being maintained by gas pressurization or water filling, in the manner earlier described.

Where such pier is both a production platform and storage vessel, drilling and well casing passages 349 extend from the base slab alongside the side lobes to the top wall 322, intersecting the brace walls and being integrally united therewith.

The foregoing description has set out the design features and fabrication methods of novel piers of great size intended to provide stable drilling and production platforms of large deck area and storage capability for deep water sites. The invention extends to structures whether standing in protected deep water or in the path of very large amplitude waves. The invention may be usefully applied in the field of oil and gas field development and petroleum production and storage, as well as for non-petroleum subterranean works such as potash mining, coal mining and/or gasification, power plant location in the sea, and so forth.

In all of the forms in which the piers according to the invention may be realized, the components of the structure include a deeply-submerged massive container or container group shaped with lobed sidewall configuration, disposed in the structure so that lateral pressure forces caused by a maximum design wave of given amplitude are reduced to acceptable limits by reason of location in depth, and by the shielding action, from two opposite directions, of perforated flanking walls. In the erection of such structures the economies of upward building by component stacking and bonding in formwork, and by slip-forming along greatly-extended perimeters are considerable. In the towing of the structure in horizontal floating state exceptionally stable and seaworthy vessel behaviour is realized. At the final site, the only part of the structure exposed to weather and vulnerable to collision by ocean craft is a structural load-carrying system comprising a number of vertically-extending members, whose form minimises wave coupling therewith.

I claim:

1. A marine pier structure for sited in the sea on a seabed in depth at least 400 feet, comprising a base slab of rectangular plan form, spaced parallel upright load-carrying walls rising from the base, a container body having parallel plane end walls and a convexly-lobed side wall integrally joined with said end walls and together enclosing a space, said upright walls extending through said container body and supporting said container body in spaced relation above said base and terminating in the sidewall at its upper surface, a system of tubular vertical columns arrayed in parallel files along said terminations of said upright walls and extending to a height near the sea surface, a pair of upright flanking load-carrying walls spaced symmetrically to either side of and parallel with said upright walls a distance about 60 feet from the container side wall, a top wall joining the upper extremities of said flanking walls and a series of tiers of tubular brace members orthogonally disposed to said flanking walls and to said vertical columns and monolithically joined therewith, said flanking walls being extensively perforated by a large multiplicity of regularly distributed transverse jet-guiding channels opening through the walls, having a combined cross-sectional channel area at least about 30% of the elevational area of the walls, a deckwork supported on said upright walls and vertical columns above the sea, and an enclosed chamber integral with said vertical columns having an internal space intersected by said tubular vertical columns.

2. A marine pier structure as set forth in claim 1 wherein said container body side wall has curvatures about line axes parallel with the width dimension of the pier and said upright walls and said side wall and said upright intersecting walls are intersected by two vertically spaced horizontal brace walls subdividing the height of the container body said brace walls extending to and being monolithically joined with said flanking walls.

3. A marine pier structure as set forth in claim 2 wherein said enclosed chamber is subdivided into two halves by a solid wall extending in line with a centered upright intersecting wall and joined with said tubular vertical columns which are aligned with said centered wall.

4. A marine pier structure as set forth in claim 3 wherein said enclosed chamber is intersected by upward continuations of files of tubular vertical columns spaced adjacently to either side of said centered file of columns.

5. A marine pier as set forth in claim 4 wherein a series of slender tubular pillars rise from said top wall which is submerged beneath mean sea surface and extend above highest wave level and are arranged as ranks and files over the upper surface area of at least part of said top wall, at least one central file of said slender tubular pillars having its internal spaces in communication with predetermined ones of other files of said slender tubular pillars having their internal spaces in communication with the upward continuations of tubular vertical columns intersecting said enclosed chamber.

6. A marine pier structure as set forth in claim 3 wherein said enclosed chamber has a convexly lobed side wall and vertical planar end walls integrally joined with said lobed side wall, and said flanking walls have inwardly curved upper terminal portions merging with said top wall and spaced horizontally from the chamber side wall.

7. A marine pier structure as set forth in claim 1 wherein said tubular vertical columns have horizontal cross-sections of which a longer dimension is aligned parallel with the flanking walls.

8. A marine pier structure as set forth in claim 5 wherein said slender tubular pillars rising out of the sea have cylindrical or slightly reducing cross-section upwardly.

9. A marine pier as set forth in claim 8 wherein the structure is disposed as a floating body with its height dimension in the horizontal and the end walls of said container body and of said enclosed chamber horizontal.

10. A marine pier structure as set forth in claim 2 wherein a pair of cylindrical hollow columns have their lower ends integral with the said base slab on opposite sides of said container body, each column extending contiguously adjacent the convexly-lobed side wall of said container body and intersecting said top wall and said deck work, said columns providing unobstructed passages substantially coextensive with the height of said pier.

11. A marine pier structure as set forth in claim 2 wherein a pair of cylindrical hollow columns have their lower ends integral with the said base slab on opposite sides of said container body, each column extending contiguously adjacent the convexly-lobed side wall of said container body and intersecting said deckwork, each said flanking wall comprising a vertical lower portion and an upper portion which is inclined to the vertical and which at its upper extremity merges with said top wall, said columns intersecting respective inclined portions of said flanking walls.

12. A marine pier as set forth in claim 1 wherein said transverse jet-guiding channels have cross-sectional areas which are constant along their length.

13. A marine pier as set forth in claim 1 wherein said transverse jet-guiding channels have cross-sectional areas which decrease along the length of the channel in the direction from the open sea toward the interior of the pier.

14. A marine pier as set forth in claim 1 wherein the transverse jet-guiding channels have smooth surfaces formed by casting said channels as thick-walled tubes of concrete in polished metal molds.

15. A marine pier as set forth in claim 1 wherein the transverse jet-guiding channels have smooth surfaces comprised as cylindrical or conical interior surfaces terminating in end openings formed as convexly-rounded surfaces merged smoothly with the exterior surfaces of the flanking wall.

16. A marine pier as set forth in claim 1 wherein the upright marginal portions of said flanking walls are convexly-rounded in any horizontal plane.

17. A marine pier as set forth in claim 1 having a system of horizontal tubular brace members orthogonally disposed with respect to said tubular vertical columns and extending parallel with the horizontal extents of said flanking walls between the tubular vertical columns of each file and being integrally joined with said tubular vertical columns adjacent their junctions with said tubular beam members.

18. A marine pier as set forth in claim 1 wherein said tiers of tubular beam members intersect ranks of tubular vertical columns in respective horizontal planes spaced apart vertically about 90 feet, an uppermost horizontal tier intersecting said enclosed chamber nearly tangentially of a lower side wall portion thereof and a lowermost horizontal tier intersecting said container body nearly tangentially of an upper side wall portion of said container body.

19. A marine pier as set forth in claim 18 wherein tubular beam members intersect those ranks of tubular vertical columns which extend above the end walls of the container body and also intersect at least one interior rank of tubular vertical columns.

20. A marine pier as set forth in claim 19 wherein there are an odd number of tubular vertical columns in the files of columns rising from the upper termination of each upright load-carrying wall and one pair of horizontal tubular beam members connect said flanking walls with respective outer ranks of said tubular vertical columns and further tubular beam members connect said flanking walls with each odd-numbered interior rank of tubular vertical columns as counted from an outer rank.

21. A marine pier as set forth in claim 3 wherein said solid wall includes passages communicating with the interior spaces of predetermined ones of said tubular vertical columns and communicating with the interior spaces of predetermined ones of said slender tubular pillars.

22. A marine pier as set forth in claim 1 wherein said slab base is a thick monolithic body and has lateral extensions formed as integral flanges projecting outwardly beyond the planes of said flanking walls and beyond the planes of the end walls of said container body.

23. A marine pier as set forth in claim 22 wherein said extensions have sloping upper surfaces and the thickness dimension of said extensions decreases outwardly of the plan outline of the pier.

24. A marine pier as set forth in claim 23 wherein the under surface of said slab base is formed with a pattern of downwardly projecting intersecting ribs.

25. A marine pier as set forth in claim 2 wherein said parallel upright load-carrying walls comprise a centered wall and a pair of auxiliary walls spaced about 90 feet to each side of said centered upright load-carrying wall, and said lobes of said container body sidewall have their marginal portions integrally joined with said auxiliary walls at their junctions with said horizontal bracewalls.

26. A marine pier as set forth in claim 25 wherein said centered upright load-carrying wall and said auxiliary upright load-carrying walls are formed with internal passages communicating with predetermined internal spaces bounded by the plane end walls of said container body and by predetermined ones of said sidewall lobes, said horizontal brace walls, and said upright walls, and said passages communicate with predetermined interior spaces of said vertical tubular columns.

27. A marine pier as set forth in claim 1 wherein said enclosed control chamber has its upper sidewall located about 60 feet below mean sea level and said deckwork is carried at a height about 60 feet above mean sea level by a series of slender tubular pillars.

28. A method of making a marine pier structure as claimed in claim 1 wherein said base, walls, columns, chambers, and container body are at least partially cast together as a unitary structure in a drydock so that the base is substantially vertical and has said columns extending horizontally therefrom, and after said at least partial structure has been cast, the structure is trimmed into a horizontal floating attitude by ballasting displacement volumes and floated to a sheltered sea site and the structure is completed as a monolithic, post-stressed body, the completed pier is then towed base aft to a site area, the structure is caused to be righted with the base down by ballasting at least said container body and said chamber, and the structure is subsequently ballasted further so as to have negative buoyancy so that it stands on seabed.

29. The method of fabricating a pier structure of greatly extended height which comprises casting an end wall of a container body as a flat slab in a drydock, casting an end wall of a chamber spaced from said container body as a flat slab in the same plane as said container end wall, casting an upright transverse top wall integral with a margin of said chamber end wall, forming three spaced walls as dividing walls intersecting said container body and extending along the pier length, casting a base slab as a transverse upright wall perpendicular to said dividing walls, casting brace walls parallel with said base slab and intersecting the open container body, erecting upwardly a transversely perforated flanking wall extending horizontally on either side of the container body and extending along either side of said chamber and terminating in said transverse top wall, erecting a system of orthogonally-intersecting tubular columns between said container body and said chamber and said flanking walls, casting tubular pillars as extensions of horizontal tubular columns beyond said chamber, and casting cylindrical hollow columns extending along the sidewall of the container body from the base through said top wall and beyond said chamber, casting at least partial sidewalls on the margins of said container and chamber end walls, floating the structure as a vessel to a sheltered sea site, completing the fabrication of the pier as a unitary monolithic, reinforced and post-stressed floating body, towing completed pier in its horizontal floating and partly-ballasted condition to a deep water site, ballasting said container body and said chamber to turn the pier upright as a vertically-elongate floating structure, and further ballasting the pier to sink it to stand on seabed.

30. The method of fabricating a pier structure as set forth in claim 29 which includes the step of capping the end openings of jet-guiding channel courses adjacent the drydock floor by means of cover members to prevent ingress of water prior to flooding of the drydock to augment buoyancy of the flanking walls.

31. The method of fabricating a pier structure as set forth in claim 29 wherein said slab base is constructed as a compartmented open-topped vessel having a closing bottom wall comprised as a slab extension, end walls comprising further slab extensions, and side walls formed as sheets forming the upper and lower surfaces of the slab base, and said compartments are filled with concrete prior to the righting of the pier into upright attitude.

32. The method of claim 29 wherein the outer ends of said slender tubular pillars are interconnected by a vestigial deckwork of grid form comprised of concrete girders.

33. The method of claim 32 further comprising the step of fabricating a deckwork or deckworks upon the vestigial deckwork after the pier is righted into upright attitude to elevate said vestigial deckwork above the sea.

34. The method of claim 32 wherein said vestigial deckwork is fabricated to integrally join said array of slender tubular pillars with the upper ends of said pair of cylindrical hollow columns.

35. The method of claim 29 wherein the pier is ballasted when in its horizontal floating attitude by admission of seawater to selected compartments of said container body and of said chamber and to some or all of the interior spaces of said tubular columns, and to some or all of said tubular pillar extensions, through predetermined ones of said tubular pillar extensions.

36. A marine pier as set forth in claim 1 wherein the distance between the sidewall of the enclosed chamber and the nearest flanking wall is at least about 40 feet.

37. A marine pier as set forth in claim 1 wherein the container body is spaced above the slab base about 40 to 60 feet.

38. A marine pier as set forth in claim 1 wherein the upper part of the container body in the standing pier is located at a depth of about 300 feet.

39. The method of righting a marine structure which is in horizontally-elongate stable floating attitude into an upright stable floating attitude, said structure comprising a massive base slab, two laterally-spaced transversely-perforated horizontally-elongate flanking walls extending to one side of the base slab, a closed compartmented container body of large positive buoyancy spaced between said flanking walls and spaced from the base slab and joined by intersecting transverse upright walls and by elongate upright walls with said flanking walls and with said base slab, a plurality of tubular horizontally elongate columns cross-connected by tubular braces extending from a sidewall portion of said container body parallel with said flanking walls, a control chamber having an enclosing upright sidewall and horizontal end-closing walls surrounding outer ends of said pillars remote from said container body, a transverse top end wall integral with said control chamber sidewall connecting terminal portions of said flanking walls, a grid array of slender tubular pillars projecting horizontally parallel with said flanking walls beyond said control chamber sidewall having root ends integral with said top wall and having their outward ends interconnected by beams, the method comprising:

ballasting said container body and said control chamber and tubular columns by admitting predetermined volumes of seawater through at least one above-surface slender pillar into selected tubular columns and interior spaces within said control chamber and within said container body to effect submergence of said base slab, of said container body, of said control chamber, and of said tubular pillars except for at least one rank thereof, the pier floating stably;

admitting further ballasting to compartments of said container body near to said base slab to develop incipient horizontal instability of the structure with said container body wholly submerged and a predetermined initial inclination with base slab downward, adding further ballast to selected compartments of said container body to induce irreversible loss of horizontal stability and to initiate a progressive righting rotation about a horizontal transverse axis intersecting the control chamber, then effecting rapid transfer of water ballast from said control chamber interior spaces into lower compartment spaces of said container body through predetermined tubular columns as hydraulic conduits by gravity flow therealong to accelerate righting rotation, while maintaining internal pressure in all pier spaces substantially near the value of sea pressure acting on exterior surfaces and while maintaining said axis sufficiently close to said top wall to maintain the outer ends of a major portion of said slender tubular pillars immersed until the inclination with respect to the horizontal of the tubular pillars of said grid array has reached a predetermined magnitude.

40. The method of claim 39 which includes the step of retaining air or gas as filling of head spaces in the container body and subjecting said air or gas filling to hydraulic fluid pressure developed by the transfer of water ballast along said conduit.

41. A marine pier of vertically-elongate monolithic structural form comprising:

a near-surface control chamber system;

a deeply-submerged storage chamber system including a compartmented closed container or group of containers;

a conduit system communicating with spaces enclosed by said chamber systems;

a load-carrying column and wall system extending in part through said storage and control chamber systems and carrying said conduit system, and a pair of perforated flanking walls spaced on opposite sides of said control chamber system and of said storage chamber system;

a deckwork carried on said load-carrying column and wall system above highest wave level;

a transverse wall and beam bracing framework extending in part through said storage and control chamber systems and uniting said load-carrying column and wall system therewith, and including a top wall and including a slab base spaced below said storage chamber system; and means for controlling the relative position of the center of mass with respect to the center of buoyancy by transfer of ballast, and for pressurizing the spaces enclosed by said chamber systems by selective admission of gas and/or liquid media, by way of said conduit system.

42. A marine pier as set forth in claim 41, wherein said conduit system is incorporated in or comprises tubular passages in at least the portion of said column and wall system which extends between said deckwork and the spaces enclosed by said control chamber system and said storage chamber system.

43. A marine pier as set forth in claim 41 wherein said top wall is beneath the sea surface and said deckwork is carried by a group of slender tubular pillars having their root ends fixed in the top wall and their upper ends tied by a gridwork of beams above the sea, and one or more of said tubular pillars form part of said conduit system.

44. A marine pier as set forth in claim 41 wherein said top wall is disposed above highest wave level and is supported by the load-carrying column and wall system which extends through the control chamber system, said load-carrying column and wall system carrying upper extremities of said conduit system.

45. A marine pier as set forth in claim 44 wherein said closed container or container group extends continuously to near sea surface as a unitary body, and said control chamber comprises upper compartments of said body.

46. A marine pier as set forth in claim 41 wherein a pair of said load-carrying columns comprise tubes extending between the slab base and the deckwork without intersecting said container or container group or said control chamber.

47. A marine pier of vertically-elongate monolithic structural form comprising:

a deeply-submerged storage chamber system including a compartmented closed container or group;

a near-surface control chamber system;

a deckwork carried above highest wave level;

a load-carrying column and wall system extending in part through the storage and control chamber systems including a pair of perforated flanking walls; and a transverse wall and beam bracing framework extending in part through said storage and control chamber systems including a top wall, and including a slab base spaced below the container or group;

wherein said storage chamber system extends continuously to near sea surface as a unitary body integral with said control chamber system and wherein the latter comprises upper compartments of said body, the chamber spaces being in fluid communication with tubular passages carried to the deckwork by said column and wall system.

48. A marine pier structure for sited in the sea on a seabed in a depth at least 400 feet, comprising:

a base slab of rectangular plan form, a system of parallel upright load-carrying walls rising from the slab base at least to maximum wave height, a storage container body of compartmented monolithic form carried on said system of walls and having its upper part located in a depth about 300 feet below mean sea surface and its lower part spaced above said base slab to provide a flow passage for relief of pressure generated by deep sea wave phenomena, a deckwork supported above maximum wave height upon said load-carrying walls, said system of load-carrying walls including a pair of perforated flanking walls spaced symmetrically to either side of said container body a distance about 60 feet and rising to near sea surface or above mean sea level, and a system of tubular passages carried by said load-carrying walls, at least some of said passages extending to said deckwork and communicating with spaces of said container body.

49. An easily installed stable storage apparatus for storing fluid beneath the surface of a body of water, comprising:

A. a base;

B. a deckwork;

C. a control chamber system containing at least one control chamber space;

D. a fluid storage chamber system containing at least one fluid storage space;

E. support means for forming a unified structure including said deckwork, said control and fluid storage chambers and said base and for positioning said deckwork above the body of water, said control chamber near the surface of the body of water and the fluid storage chamber deeply within the body of water, said support means including:

a. load carrying members oriented vertically when in operative position extending in part through said control chamber space and through said fluid storage space, b. transverse bracing members extending in part transverse through said control chamber space and said fluid storage space when in operative position, said transverse bracing members intersecting and uniting said load carrying members therewith;

c. stabilizing means for dissipating the effects of wave motion within the body of water said stabilizing means including a pair of perforated flanking walls; and F. control means for controlling the relative position of the center of mass with respect to the center of buoyancy of said unified structure by selective transfer of material into and out of said control chamber and said fluid storage chamber, said control means including a conduit system for communicating with said control chamber space and said fluid storage space.

50. Apparatus as defined in claim 49, wherein said fluid storage chamber has a lower extremity spaced above said base to form a flow passage for relief of pressure generated by deep water wave phenomena.

* * * * *